US008505523B1

(12) United States Patent
Horn

(10) Patent No.: US 8,505,523 B1
(45) Date of Patent: Aug. 13, 2013

(54) BOW PRESS WITH ENHANCED SAFETY FEATURES

(76) Inventor: Charles Edward Horn, Cedar Rapids, IA (US)

( * ) Notice: Subject to any disclaimer, the term of this patent is extended or adjusted under 35 U.S.C. 154(b) by 0 days.

(21) Appl. No.: 13/449,022

(22) Filed: Apr. 17, 2012

Related U.S. Application Data

(63) Continuation-in-part of application No. 12/652,086, filed on Jan. 5, 2010, now Pat. No. 8,387,600, which is a continuation-in-part of application No. 13/100,575, filed on May 4, 2011.

(51) Int. Cl.
*F41B 5/14* (2006.01)

(52) U.S. Cl.
CPC ..... *F41B 5/1449* (2013.01)
USPC ..... 124/1; 124/86

(58) Field of Classification Search
CPC ..... F41B 5/1449
USPC ..... 124/1, 86
See application file for complete search history.

(56) References Cited

U.S. PATENT DOCUMENTS

| | | | | |
|---|---|---|---|---|
| 3,055,655 | A * | 9/1962 | Chelf | 29/235 |
| 5,022,377 | A * | 6/1991 | Stevens | 124/23.1 |
| 5,222,473 | A * | 6/1993 | Lint | 124/86 |
| 5,370,103 | A * | 12/1994 | Desselle | 124/86 |
| 5,433,186 | A * | 7/1995 | Corwin | 124/86 |
| 5,791,324 | A | 8/1998 | Johnson | |
| 5,983,879 | A * | 11/1999 | Gifford | 124/1 |
| 6,220,235 | B1 * | 4/2001 | Sands | 124/1 |
| 6,386,190 | B1 * | 5/2002 | Kurtz, Jr. | 124/1 |
| 6,932,070 | B1 * | 8/2005 | Kurtz, Jr. | 124/1 |
| 2,968,834 | A1 | 11/2005 | Gibbs | |
| 6,968,834 | B1 * | 11/2005 | Gibbs | 124/1 |
| 7,089,923 | B2 | 8/2006 | Johnson | |
| 7,185,644 | B2 * | 3/2007 | Kurtz, Jr. | 124/1 |
| 7,255,099 | B2 * | 8/2007 | Henry | 124/1 |
| 7,311,095 | B2 * | 12/2007 | Bauder | 124/1 |
| 7,597,094 | B2 * | 10/2009 | Pittman | 124/1 |
| 7,644,708 | B2 * | 1/2010 | Pittman | 124/1 |
| 8,096,059 | B2 * | 1/2012 | Stagg | 33/506 |
| 8,387,600 | B1 * | 3/2013 | Horn | 124/1 |
| 2006/0000462 | A1 * | 1/2006 | Kurtz | 124/1 |

(Continued)

OTHER PUBLICATIONS

SURE-LOC Archery Products Catalog, p. 31, C. S. Gibbs Corporation, Versailles, IN.

(Continued)

*Primary Examiner* — Gene Kim
*Assistant Examiner* — Alexander Niconovich
(74) *Attorney, Agent, or Firm* — Allan L. Harms; Shuttleworth & Ingersoll, PLC

(57) ABSTRACT

An improved archery bow press used to safely relieve tension in the bow string of a short limbed compound archery bow. Slidable brackets are retained to a horizontal beam and retain pivot arms to the beam. Brackets slidable along each of the pivot arms may be locked in place. Each pivot arm includes a bearing member which abuts a limb of a compound bow. A jack is mounted to the beam to raise and lower link members connected to the pivot arms. The link members are adjustable in length. Markings are provided on the adjustable members so that adjustments to those elements can be made based on data in a table correlating settings for specific compound bows. Safety latches lock the bow limbs to the slidable brackets. A method for presetting the press is provided.

16 Claims, 17 Drawing Sheets

(56) References Cited

U.S. PATENT DOCUMENTS

| | | | | |
|---|---|---|---|---|
| 2006/0191522 | A1* | 8/2006 | Henry | 124/23.1 |
| 2007/0079818 | A1* | 4/2007 | Bauder | 124/1 |
| 2007/0119438 | A1* | 5/2007 | Pittman | 124/1 |
| 2009/0056688 | A1* | 3/2009 | Marsh et al. | 124/1 |
| 2009/0071022 | A1* | 3/2009 | Stagg | 33/265 |
| 2009/0107475 | A1* | 4/2009 | Pittman | 124/86 |
| 2010/0089376 | A1* | 4/2010 | Bunk et al. | 124/86 |
| 2011/0162631 | A1* | 7/2011 | Tulpa | 124/86 |
| 2011/0232616 | A1* | 9/2011 | Gouramanis | 124/1 |

OTHER PUBLICATIONS

SURE-LOC Archery Products website: http://sureloc.com/products/bowpress/X-Press-Pro-Bow-Press.php.

Office Action dated Jul. 20, 2012 from related U.S. Appl. No. 12/652,086.

* cited by examiner

290

| | Beam Bracket Setting (291) | Limb Deflector Bracket Setting (292) | Link Member Hole # (293) | Jack Stand Setting (294) |
|---|---|---|---|---|
| Bow Model 1 | 23 | P | 10 | C |
| Bow Model 2 | 25 | F | 12 | D |
| Bow Model 3 | 31 | N | 15 | G |

FIG. 10

356

| Bow Model (358) | Jack Stand Setting (360) | Bracket Setting Along Beam (362) | Pivot Arm Bracket Location (364) | Limb Block Orientation (366) | Link Length Setting (368) |
|---|---|---|---|---|---|
| Bow Model 1 | C | 23 | N | B | 11 |
| Bow Model 2 | D | 25 | P | C | 13 |
| Bow Model 3 | G | 31 | R | D | 16 |

FIG. 16

BOW PRESS WITH ENHANCED SAFETY FEATURES

CROSS REFERENCE

This application claims priority from U.S. patent application Ser. No. 12/652,086 filed Jan. 5, 2010 and U.S. patent application. Ser. No. 13/100,575 filed May 4, 2011, which applications are hereby incorporated by reference.

BACKGROUND

The present invention relates to bow presses for maintenance of compound archery bows.

A typical compound archery bow includes a pulley at one end and an eccentric cam at the opposite end around which the cable of the bowstring is passed. The stringing or tuning of a compound bow, with its eccentrically mounted cam and its pulley, tension cable and bow string, is critical to achieve a proper balance of the eccentrically mounted pulleys or cams. The complexity of the stringing and the sensitivity to proper tuning of the bow, makes it very difficult to string and tune a compound bow without the aid of a bow press.

Periodic retuning of compound bows is often required to maintain desired performance levels. For retuning and to change, replace or repair components of the compound bow, such as the bowstring, string sights, dampers, the tension cable, the cams and other components, a bow press is required.

Through the years a number of bow presses have been developed for facilitating stringing and maintenance of compound bows. In general, these presses have included a stationary base having a pair of spaced apart inside surface supports, in the form of pegs or rollers, for contacting the inside of the bow, and a pair of limb supports, in the form of pegs or rollers, attached to a movable mechanism for applying a bending force to the limbs of the bow. Such a bow press is described in Gibbs, U.S. Pat. No. 6,968,824.

It is very important that the inside surface support and the limb supports of the bow press be precisely positioned in such a manner that the bow is properly loaded into the press in a manner that when the limbs are bent, the forces will not overstress or otherwise damage the bow. Because compound bows vary dimensionally, particularly in riser length, it is necessary that the inside surface support and the limb supports on the bow press be adjustable. In the past, it has been customary to provide incremental holes in the bow press so that the position of the inside surface support and the limb supports could be moved to achieve a satisfactory fit with regard to a given bow. The incremental nature of this adjustment approach often results in a fit of the bow press to the bow which is not quite ideal, and can result in damage to the bow. In the patent to Gibbs, U.S. Pat. No. 6,968,834, an improvement is made to allow manually adjustable sliding clamps which are selectively moveable along a beam and when located properly, may be clamped to the beam by tightening bolts or set screws.

As archery technology has progressed, compound bows have been developed which include much shorter limbs than earlier compound bows, with the short limbs designed to join the bow riser at a substantial angle approaching a perpendicular, and hence the limbs sweep back toward the user. These swept back limb bows are frequently termed "parallel" limb bows or "short limb" bows. Pressing of such bows in the prior art bow presses has proved to be challenging.

Certain deficiencies in the bow press disclosed in Gibbs, U.S. Pat. No. 6,968,834 have been identified, especially when such, a bow press is used with short limb bows. First, the adjustability of the link members which connect the pivot arms to the jack is challenging to accomplish by a lone user because the user must employ one hand to lift one pivot arm so that the limb engaging member abuts the limb while at the same time attaching the link member to the jack and when the link member to attached is the second, matching the link member's effective length to the other link member. Then, if a user forgets to place the spring clip to retain the link members to the jack, the link members may slide off the pin on the jack when compression is applied to the bow, causing a potentially injurious condition.

Additionally, with a bow press such as disclosed in Gibbs, U.S. Pat. No. 6,968,834, retention of the limb deflecting brackets along the pivot arms by friction, through use of a set screw, requires excessive effort to adequately secure the bracket in place along the pivot arm.

A conventional bow press must be adjusted each time the press is to be used, to adjust the press for the particular bow to be pressed, until the adjustable elements of the press are matched to the particular bow. This is usually accomplished through time consuming experimentation.

Finally, when pressing a parallel or other short limb bow with a conventional bow press, it is possible to compress the limbs toward one another to the point where the bow may spring out of the bow press, escaping containment and creating a dangerous condition.

These safety and efficiency deficiencies deserve remediation.

It is desirable, therefore, to provide an improved bow press apparatus which overcomes problems and shortcomings of prior art bow presses, and allows safe compression of a short limb bow.

SUMMARY OF THE INVENTION

The present invention provides an improved archery bow press used to relieve tension in the bow string of a compound archery bow so that maintenance and repair of the bow string and its components may be safely and easily accomplished. The invention also describes a method for setting a bow press in advance of attaching the bow, by reference to a table of compiled data correlated to a list of differing makes and models of bows which may be compressed on the bow press.

The archery bow press provides a support base supporting an elongate beam oriented horizontally. An upright screw jack is located midway along the beam and is retained to the beam. An elongate threaded rod is mounted to the base adjacent and parallel to the elongate beam. The threaded rod is supported at each opposing end and the rod is also supported in a central housing where the rod contains no threads. The first half of the rod is threaded with right hand threads and the second half of the rod is threaded with left hand threads. A pair of pivot arm bracket members is slidable along the beam with one bracket member on each opposing side of the midpoint of the beam. The pivot arm bracket members are coupled to the threads of the threaded rod such that rotation of the rod will cause the pivot arm bracket members to be drawn together or moved apart depending on the direction of rotation of the threaded rod. A hand drivable member coupled to one end of the threaded rod permits convenient rotation of the threaded rod in the desired direction. The hand drivable member may be a coaxial hand wheel joined coaxially to one end of the threaded rod, or it may be a right hand gear box which permits a crank to turn the threaded rod. Pivot arms are hinged to each of the pivot arm bracket members and each pivot arm has a limb support bracket member selectively slidable along its length. An elongate link member is hinged to each of the limb support bracket members with each of the link members also retained to the screw jack which is retained to the midpoint of the beam. The elongate link members are adjustable in length. A laterally extending cushioned riser support rod is mounted to each pivot arm bracket such that a bow can be suspended under the laterally extending riser support rods by elastomeric bands. The pivot arm brackets are caused to move along the beam by use of the hand drivable member which rotates the elongate threaded rod, so that the riser support rods can be located below the each limb where it joins to the bow riser at the limb pocket.

A splined rod extends perpendicularly from each limb support bracket member, the splined rod being non-rotatable upon the limb support bracket member. A pair of spaced apart limb engagement blocks is received on the splined rod. The limb engagement blocks are positioned such that a bearing surface of each may bear on the limb on opposing sides of the cam or pulley supported on the limb.

Optionally, when desired, a pin support bracket may be adjustably connected to each of the elongate link members. Each pin support bracket may support a horizontally projecting tapered pin having a generally conical shape and having an annular groove near the tip of the pin into which the bow string of the compound bow may be temporarily placed during repair and maintenance of the bow string.

The present invention also provides limb safety latches which may be easily attached to the how press when the bow is in place on the bow press ready to be compressed. Each safety latch locks the limb to the bow press to prevent the bow from escaping downward from the bow press when the bow is compressed, especially when the bow is of the parallel limb variety, wherein the limbs of the bow extend from opposing ends of the riser of the bow at substantial angles, that is, by at least seventy-five degrees from the longitudinal axis of the riser.

Two embodiments are described. In a preferred embodiment particularly for use with a split limb bow, limb latching members can be added to the bow press when the bow is in place ready to be compressed. Each limb latching member locks the bow to the press by securely retaining each split limb element to the riser support rod which it abuts. Each limb latching member has a curved hook which extends over the riser support rod and connects with a transverse bar which sits below the split limb and extends across it, the shank of the hook passing between the split limb elements of the split limb.

In a second embodiment for bows which are equipped with either solid limbs or split limbs, the limbs may be retained to the bow press by temporary attachment of limb retainers to the riser support rods on each side of the bow press. This second embodiment includes first and second parallel pins, the spacing between them being adjustable. The pins are mounted to a plate element which includes a slotted opening such that one pin may be slid along the slotted opening and then locked in place. The other pin is fixed to the plate element.

Each inside surface support rod is provided with a coaxial opening into which one of the pins of the limb retainer may be inserted. The other pin is placed below the respective limb which is abutted to the inside surface support rod and the pins are brought together before compression begins and the moveable pin is tightened to the plate element when the second pin is touching the exterior surface of the limb member. The limb retainer locks the limb to the inside surface support rod and prevents the limb from escaping the bow press even if the elastic bands which suspend the bow from the inside surface support rods are overpowered.

In one use of the archery bow press, with the limbs of the bow urged toward each other to reduce tension on the bow string, a cable section of the bow string may be detached from the bow and attached to one of the tapered pins, whereupon the screw jack may be lowered to relieve deflection of the limbs relative to the riser. A flexible strap may be employed to temporarily connect a segment of the bow string to the bow riser in order to place tension on the bow string. With this application, the cable section attached to a pin may then be refurbished, e.g., reserved.

Because of the inclusion of a user drivable member at an end of the threaded rod, a user need not move from a position near the riser of a bow in the bow press while adjusting the separation of the pivot arm bracket members along the beam because when the spacing between the pivot arm brackets is being selected, it is to conform the distance between the riser support rods which are to engage the inner face of the bow so that the those riser support rods are spaced just outboard of the connection of the bow limbs to the bow riser at the limb pocket.

Markings or scale indications are provided along the front face of the elongate beam so that the location of the right hand pivot arm bracket can be preset along the beam, with the left hand pivot arm bracket thereby also being preset along the beam because they are coupled through connections with the threaded rod. In the preferred embodiment of the present invention, markings are provided along each pivot arm so that the limb deflector bracket movable along the pivot arm can be moved to a predetermined location and a lock pin dropped through the limb deflector bracket into a selected hole along the pivot arm, thereby locking the limb deflector bracket securely into place along the pivot arm on which it is supported.

Furthermore, in the preferred embodiment, link members which couple the pivot arms to the jack are telescopically adjustable in length and may be adjusted without detaching either end of the link member. The link members are marked with numbers or letters or other markers which indicate the extension of the link members. Drop in pins are used to lock the lengths of the link members before the jack is extended. The ends of the link members need not be removed from their locations on the press to effectuate adjustment of their effective lengths. Therefore, the opportunity for error in use of the press is reduced since the user need not remove the upper ends of the link members to reposition them to the jack and possibly fail to properly latch the links to the jack.

Additionally, scale markings are provided along the extendible section of the jack so the appropriate extension of the extendible section can be selected for pressing of the bow, once the bow is secured in the bow press and after other adjustments have been made.

A compilation of data in the form of a data table is supplied with the bow press, the data table including data which correlates a given type or make of bow with the placement of the adjustable members when the bow press is being prepared to compress a particular bow. Thus, the user is enabled to preset the bow press for his or her particular bow without having to adjust the press while the bow is suspended from the riser support rods. In addition, the user may either preset the bow press for maintenance of the bow string, or preset the bow press for complete disassembly of the bow, such as when removal of the limbs is desired. In the case of use of the bow press in a bow repair facility, the press operator will consult the data table to locate the settings of the bow press for a particular bow to be serviced, presetting the jack extensible member, locating the pivot arm brackets along the main beam, locating the limb engagement brackets along the pivot arms, setting the starting extension of the link members, and placing the limb engagement blocks at a proper rotational orientation.

A primary object of the invention is to provide an archery bow press that is easy and safe to use. The objective of improved safety is provided by the telescoping links and the limb retainers which lock a short limbed bow to the bow press. Elimination of a need to detach the link members from the jack prevents accidental failure to install a locking member to retain each limb member to the jack.

It is a further object of the invention to provide an improved bow press for short limbed bows which allows safe and secure compression of a short limbed bow and which protects the bow from damage during compression.

Another important objective of the invention is to provide a method to preset a bow press depending on the particular compound bow to be compressed, by reference to a compilation of data in a data table which correlates the starting positions of the adjustable parts of the bow press to the make or model of bow to be pressed.

Further objects of the invention are: to provide a how press which features markings on the adjustment parts thereof which permits set up of the press depending on the brand and model of compound bow to be compressed in the bow press.

These and other objects of the invention will be understood from the detailed description of the invention which follows.

BRIEF DESCRIPTION OF THE DRAWING FIGURES

FIG. 10 is an exemplary table of bow press member settings cross referenced to bow models.

FIG. 16 is an exemplary table showing the settings for adjustable members of the bow press correlated with various makes and models of short-limbed bows that may be compressed in the bow press of the present invention.

DETAILED DESCRIPTION

Figure 1:
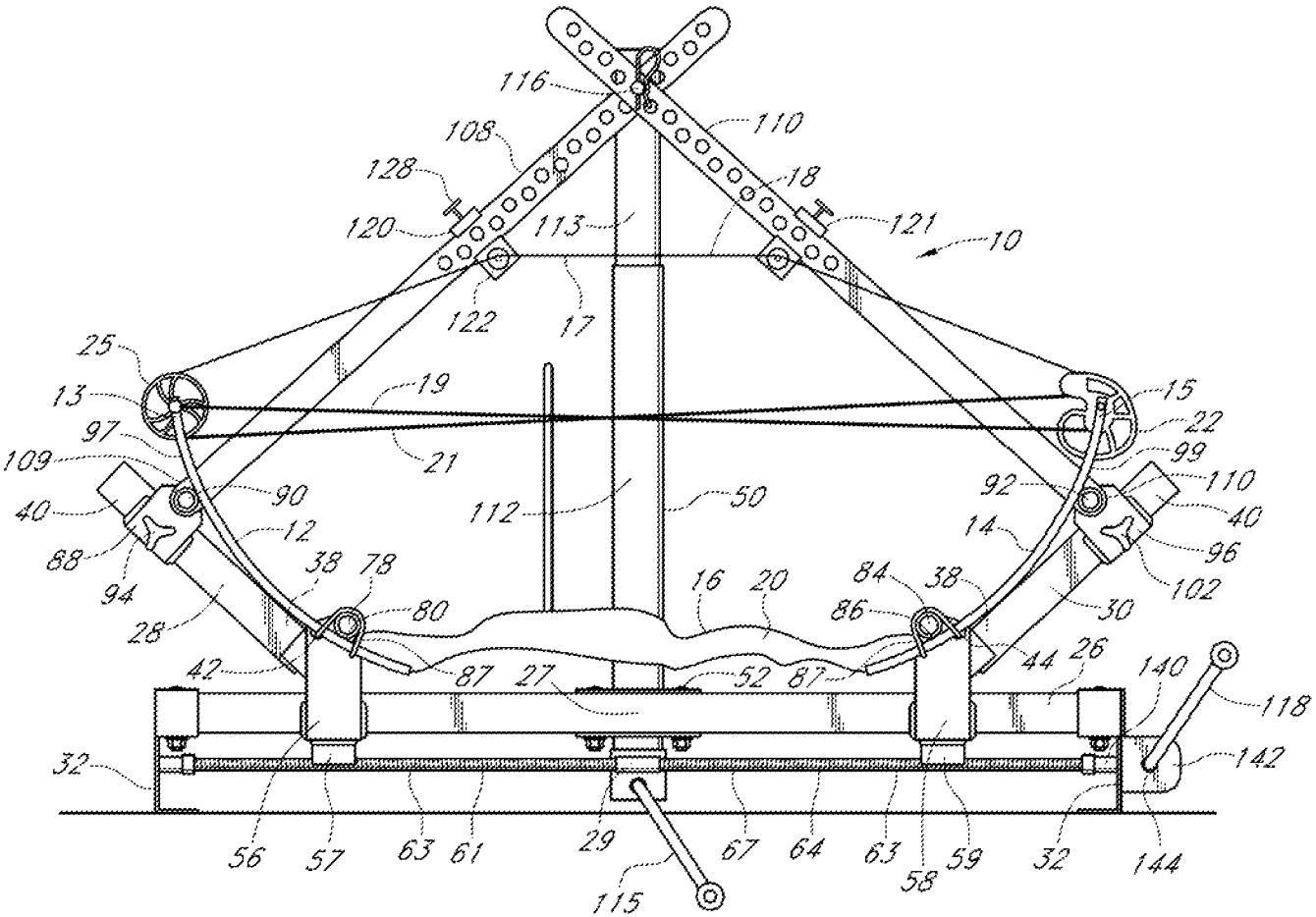
FIG. 1 is a front elevation of an archery bow press with a compound bow installed on the bow press of the invention.

Throughout this disclosure, identical parts are identified by the same reference numerals.

Figure 2:
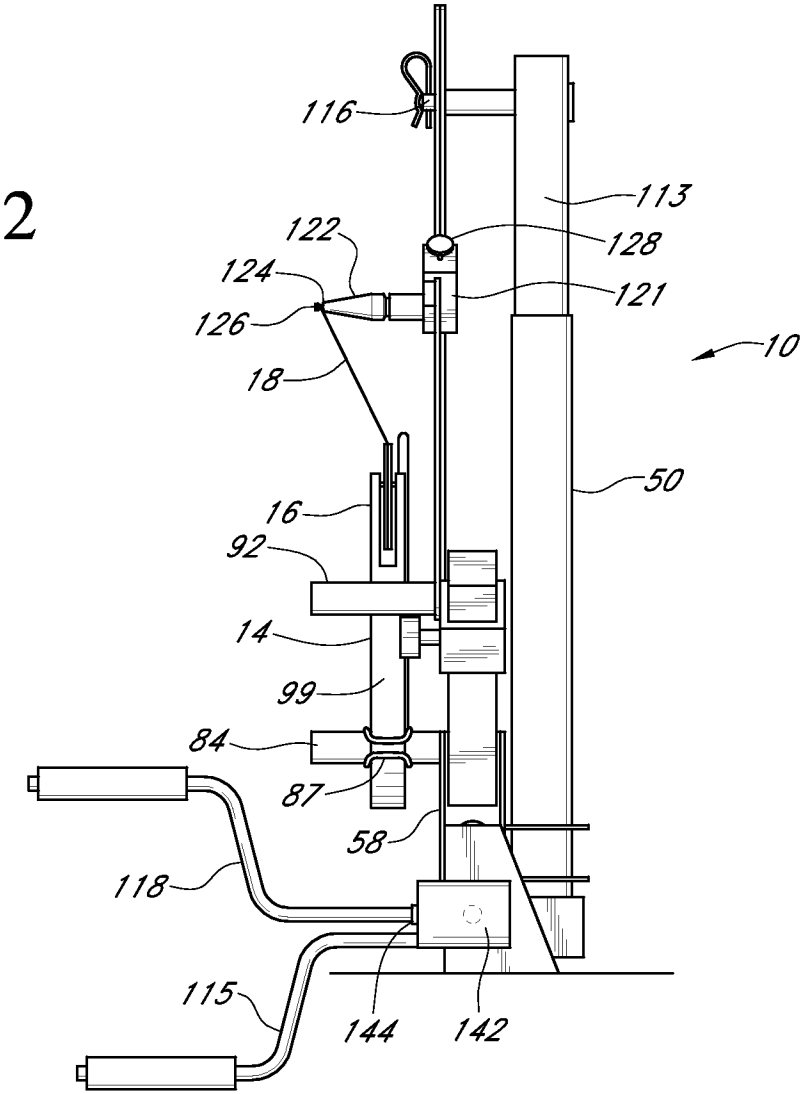
FIG. 2 is a side plan view of the archery bow press of FIG. 1.
Figure 3:
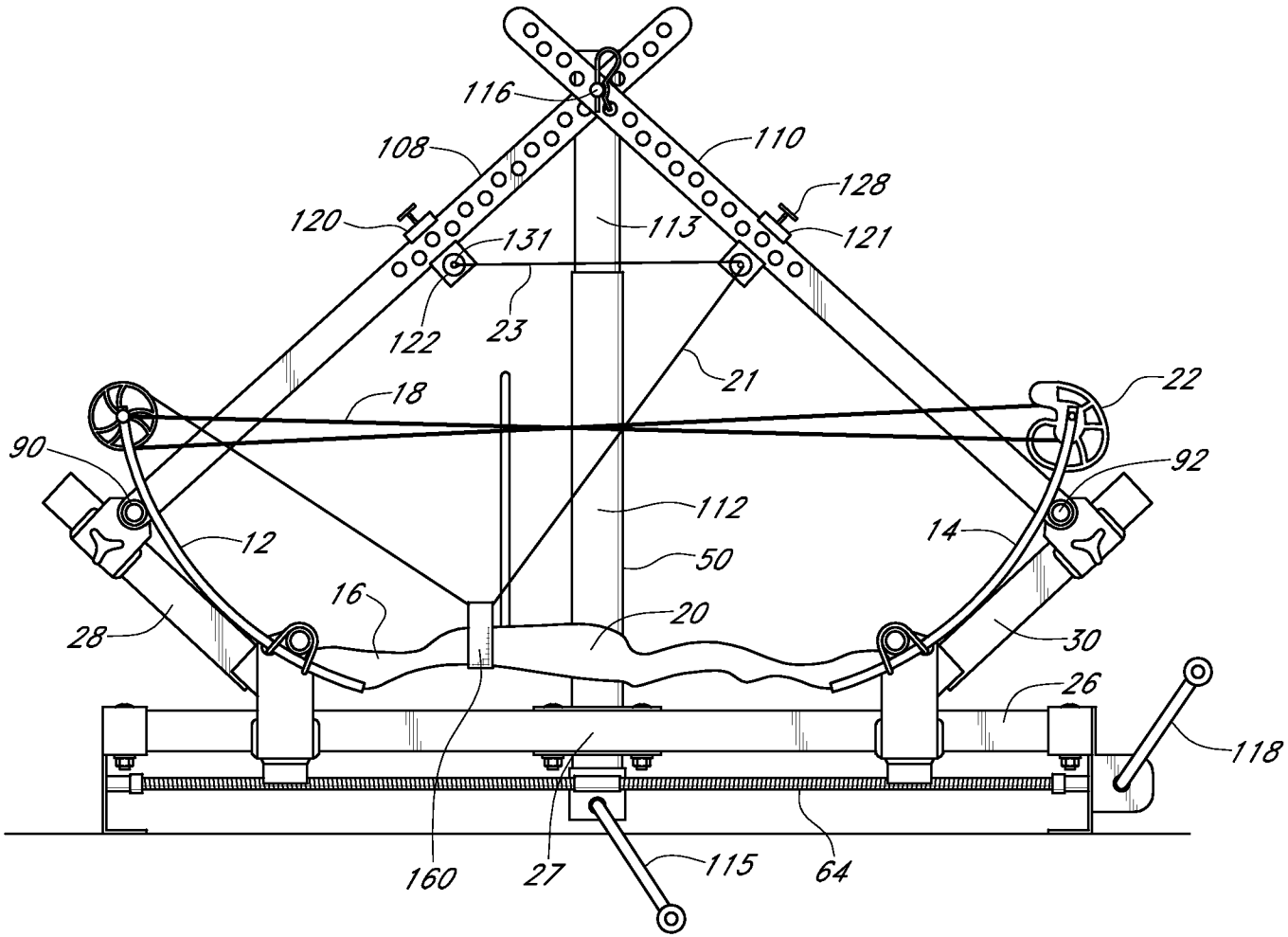
FIG. 3 is a front elevation of the archery bow press of FIG. 1 with a compound bow installed thereon and with one end of the bow string cable disconnected from one limb of the bow and secured to an element of the bow press.

FIGS. 1-3 illustrate an embodiment of an archery bow press 10 for deflecting the limbs 12, 14 of an archery bow 16 relative to the riser 20 thereof, to allow installation, replacement, repair or adjustment of a bow string 18 of the bow 1.6. The bow 16 includes a riser 20 from which limbs 12, 14 extend from opposing ends thereof. The bow 16 includes a pulley 25 at the distal end of limb 12 and a cam 22 at the distal end 15 of the limb 14.

Bow press 10 includes an elongate main beam 26, first and second pivot arms 28, 30, and pivot arm brackets 56, 58 which retain the first and second pivot arms 28, 30 to the main beam 26. First and second pivot arms 28, 30 are adapted for urging the limbs 12, 14 toward each other to relieve tension on the bow string 18.

The first and second pivot arms 28, 30 are spaced from one another along the main beam 26, with each of the first and second pivot arms 28, 30 having a hinged end 38 and a distal end 40. The pivot arm brackets 56, 58 are slidingly retained to the main beam 26.

The hinged end 38 of each pivot arm 28, 30 is attached by pivot arm bracket 56, 58 to the main beam 26, for pivoting motion about pivot axles 42, 44 which retain pivot arms 28, 30 to pivot arm brackets 56, 58, such that pivot arms 28, 30 move in a common plane with main beam 26.

An upstanding screw jack 50 is mounted to main beam 26 by mounting assembly 52 and extends upward perpendicularly from the main beam 26 at its midpoint 27.

An adjustment rod 64 is interconnected with each pivot arm bracket 56, 58 by screw followers 57, 59 such that simultaneous selective sliding movement of the first and second pivot arm brackets 28, 30 may be effected along the main beam 26, toward or away from the midpoint 27 of beam 26.

The adjustment rod 64 is retained to the main beam 26 by central bracket 29 which allows adjustment rod 64 to turn freely. Adjustment rod 64 is provided with screw threads therealong with the pitch of the threads 61 of the left end 63 reversed to the pitch of the threads of the right end 65, that is threads 61 may be right hand threads and threads 67 may be left hand threads, or vice versa. Adjustment rod 64 is operatively connected to the first and second pivot arm brackets 56, 58 such that both pivot arm brackets 56, 58 move at the same rates of travel along the main beam 26 though in opposing directions.

The exemplary embodiment of the bow press 10 of FIGS. 1-3 includes a first inside surface support 78, adapted for contacting an inside surface 80 of first limb 12 near its connection to the riser 20. The invention allows the first inside surface support 78 to be placed as close as possible to the connection of the first limb 12 to the riser 20, so that the bow 16 can bend in the bow press 10 about the interconnection of the first limb 12 and the riser 20. Similarly second inside surface support 84 contacts inside surface 86 of limb 14 near its connection to riser 20. Preferably inside surface supports 78, 84 are cushioned cylindrical rods. Elastic bands 87 selectively are applied to bow 16 to retain bow 16 to inside surface supports 78, 84.

The first inside surface support 78 is attached to the first pivot arm bracket 56 so that its axis is at a short fixed distance inboard of the first pivot axle 42, with respect to the midpoint 27 of beam 26. This closely adjacent but slightly inboard positioning of the first inside surface support 78 with respect to the pivot axle 42 of the first pivot arm 28, together with having both the first inside surface support 78 and first pivot axle 42 located at a fixed distance from one another on the first pivot arm support bracket 56, provides an advantageous arrangement for properly supporting the inside surface 80 of the bow 16 in a manner that allows the first limb 12 to flex during use of the bow press 10 in a manner that is very similar to the way the first limb 12 flexes when the bow 16 is in normal use.

The second inside surface support 84 is attached to the second pivot arm bracket 58 so that the axis of second inside surface support 84 is a short fixed distance inboard of the second pivot axle 44, with respect to the midpoint 27 of beam 26. This closely adjacent but slightly inboard positioning of the second inside surface support 84, with respect to the pivot axle 44 of the second pivot arm 30, together with having both the second inside surface support 84 and second pivot axle 44 located at a fixed distance from one another on the second pivot arm bracket 58, provides an advantageous arrangement for properly supporting the inside surface 86 of the limb 14 in a manner that allows the second limb 14 to flex during use of the bow press 10.

The bow press 10 further includes a first limb deflector bracket 88 slidingly attached to the first pivot arm 28, with a first limb engaging arm 90 extending laterally from the first limb deflector bracket 88. The first limb engaging arm 90 is adapted for contacting an outside surface 97 of the first limb 12 at a point along the first limb 12 displaced from its connection to riser 20. The first limb deflector bracket 88 includes a locking mechanism 94 for locking the first limb deflector bracket 88 to the first pivot arm 28 at a selected location with respect to the first pivot axle 42.

In similar fashion, a second limb deflector bracket 96 is slidingly attached to the second pivot arm 30 and includes a second limb engaging arm 92 extending laterally and perpendicularly from the second limb support bracket 96, with the second limb engaging arm 92 contacting an outside surface 99 of the second limb 14 at a point along the second limb 14 spaced away from riser 20. The second limb deflector bracket 96 includes a locking device 102 such as a locking screw which selectively locks the second limb deflector bracket 96 against movement along the second pivot arm 30 at a selected location with respect to the second pivot axle 44. Limb engaging arms 90, 92 are relatively short but preferably extend perpendicularly from each of pivot arms 28, 30.

The bow press 10 further includes a screw jack 50 substantially centered on beam 26, as well as a first link 108 and a second link 110. The screw jack 50 has a stationary base section 112 attached to the main beam 26 of the bow press 10 by jack mounting brackets 52. The screw jack 50 further includes an extensible section 113 telescoping from base section 112 of the screw jack 50. The screw jack 50 is attached to the main beam 26 at its midpoint 27 in such a manner that when first screw crank 115 is turned, the extensible section 113 of the screw jack 50 extends or retracts from base section 112.

The first and second links 108, 110 each have a first end 109, 111 pivotably attached respectively to the first and second limb engaging arms 90, 92, so that each pivots freely with respect to pivot arms 28, 30. The first and second links 108, 110 cross and are each removably joined to the other by a pin 116 mounted to and extending perpendicularly from the extensible section 113 of the screw jack 50.

The first and second links 108, 110 have equal lengths between their respective first ends 109, 111, and the common connection provided by the pin 116. The screw jack 50 functions to raise and lower both pivot arms 28, 30 together thereby exerting lifting force to limb engaging arms 90, 92 and hence applying bending force to the limbs 12, 14 of bow 16 mounted in the bow press 10.

Each of first and second links 108, 110 includes a pin support bracket 120, 121 which may be selectively slidable along the respective link 108, 110. Adjustment of pin support brackets 120 along links 108, 110 is accomplished by loosening lock screws 128 of each pin support bracket 120, 121. Each pin support bracket 120, 121 includes a protrusion, preferably a cylindrical pin 122, extending horizontally therefrom generally perpendicular to links 108, 110 and extending over bow 16. From FIG. 2 it can be seen that cylindrical pins 122 are preferably tapered and each includes a groove 124 near its free end 126. The grooves 124 are selected to receive the bow string 18 when deflected from its ordinary use position. The length of pins 122 and placement of grooves 124 on each pin 122 are selected such that they preferably lie outside the plane defined by the centerline of the bow riser 20 and the beam 26. Therefore, with the tension on bow string 18 relaxed by flexing of limbs 12, 14, the nock portion 17 of the bow string 18 may be displaced from the cable sections 19, 21 of the bow string 18. Then the extensible section 113 of screw jack 50 may be lowered, returning tension to bow string 18. Replacement of worn or broken serving wrapped around nock portion 17 may be easily accomplished when the nock portion 17 is pulled upward and placed on grooves 124 of pins 122. Pins 122 serve to laterally and vertically separate nock portion 17 from the remainder of bow string 18.

First end 140 of adjustment rod 64 is coupled to a gear box 142 adapted to allow adjustment rod 64 to be rotated from a perpendicular direction. Specifically gear box 142 houses a spider gear which allows a second crank 118 to apply rotational force to crank coupling 144 of gear box 142 with the result that adjustment rod 64 rotates. As adjustment rod 64 rotates, threaded couplers within each of screw followers 57, 59 are driven by opposing threads 61, 67 causing pivot arm brackets 56, 58 to converge or diverge at equal rates. Thus pivot arms 28, 30 are symmetrically adjusted to accommodate the length of a bow 16 to be pressed. Because the bow 16 to be pressed in bow press 10 must be supported by the user as the pivot arms 28, 30 are moved, having a crank coupling 144 facing the holder of the bow 16 eases the chore of adjusting the bow press 10 to fit the bow 16 such that inside surface supports 78, 84 are positioned just outboard of the limb connections of limbs 12, 14 to riser 20. Then elastic straps 87 can be applied to suspend bow 16 from inside surface supports 78, 84.

Importantly, gear box 142 at first end 140 of adjustment rod 64 permits rotation of adjustment rod 64 by a user using second crank 118 to rotate the crank coupler 144 while standing in front of bow press 10 and holding bow 16. This allows the user to easily reposition the pivot arm brackets 56, 58 while suspending the bow 16 with one hand until the separation of pivot arm brackets 56, 58 is appropriate so the bow limbs 12 and 14 are supported properly.

FIG. 3 illustrates the bow press 10 in use to support bow 16 while cam end 131 of cable portion 21 of bow string 18 is repaired. With bow 16 placed onto bow press 10 with extensible section 113 retracted into stationary section 112 of screw jack 50 such that limb engaging arms 90, 92 do not touch limbs 12, 14, and with bow string 18 attached to bow 16 in condition for use, extensible section 113 may be raised thereby flexing limbs 12, 14 toward screw jack 50. Deflection of limbs 12, 14 toward each other relaxes tension on bow string 18 and permits detachment of first cam end 131 of cable portion 21 of bow string 18 from cam 22. Cable portion 21 can then be passed around tapered pin 122 of second pin support bracket 121 and attached to pin 122 of first pin support bracket 120 which is attached to first link 108. A variable length strap 160 may be placed around both cable portion 21 and riser 20 to retain cable portion 21 to riser 20. Thereafter, extensible section 113 of screw jack 50 is lowered, returning tension to bow string 18. By careful attention to the preservation of twist in bow string 18 when it is detached from cam 22 and hooked to pin 122 of first pin support bracket 120, the tuning of bow string 18 can be preserved while repair to serving wound around cable portion 21 is accomplished. Once repair has been completed, such as by replacement of serving around the end section 23 of cable portion 21, extensible section 113 can again be extended thereby pressing limbs 12, 14 toward each other and detensioning bow string 18. This permits easy and safe removal of strap 160 and reattachment of cam end 131 to cam 22 while tuning of bow string 18 is maintained as previously set.

When the bow press 10 is to be used, the position of the inside surface supports 78, 84 and limb engaging arms 90, 92 are adjusted to fit the bow 16. First crank 115 is applied to screw jack 50 to retract the extensible section 113 of the screw jack 50 to an initial position where the bow 16 can be inserted without resistance into the press 10 with the inside surface supports 78, 84 generally on the inside of the bow 16 and closely adjacent the attachments of the first and second limbs 12, 14 to the riser 20. Adjustment of the spacing of pivot arm brackets 56, 58 is accomplished by turning adjustment rod 64 with second crank 118. The limbs 12, 14 will be inboard of the first and second limb engaging arms 90, 92.

The connection point between the first and second links 108, 110 may also be adjusted if necessary by repositioning pin 116 in different holes in links 108, 110 to allow placement of the bow 16 into the bow press 10. Adjacent holes in the links 108, 110 are laterally offset from one another to aid in visually connecting the links 108, 110 to the pin 116 in such a manner that the links 108, 110 have equal lengths between their respective first ends at the first and second limb engaging arms 90, 92, and the common connection provided by the pin 116.

By virtue of the construction of the bow press 10 as described above, the position of the first and second pivot arm brackets 56, 58 along the beam 26 is easily adjustable to thereby allow for very precise and proper positioning of the location of the inside surface supports 78, 84 to match the bow 16. Also, by virtue of the coupling of adjustment rod 64 to pivot arm brackets 56, 58, as either of the first or second pivot arm brackets 56, 58 is moved along the beam 26, the other pivot arm bracket moves an equal distance in the opposite direction along the beam 26, so that the first and second bow supports 78, 84, and the pivot pins 42, 44 are always maintained at symmetrical locations with respect to the upstanding screw jack 50, regardless of where either of the pivot arm brackets 56, 58 is positioned along the beam 26.

Figure 4:
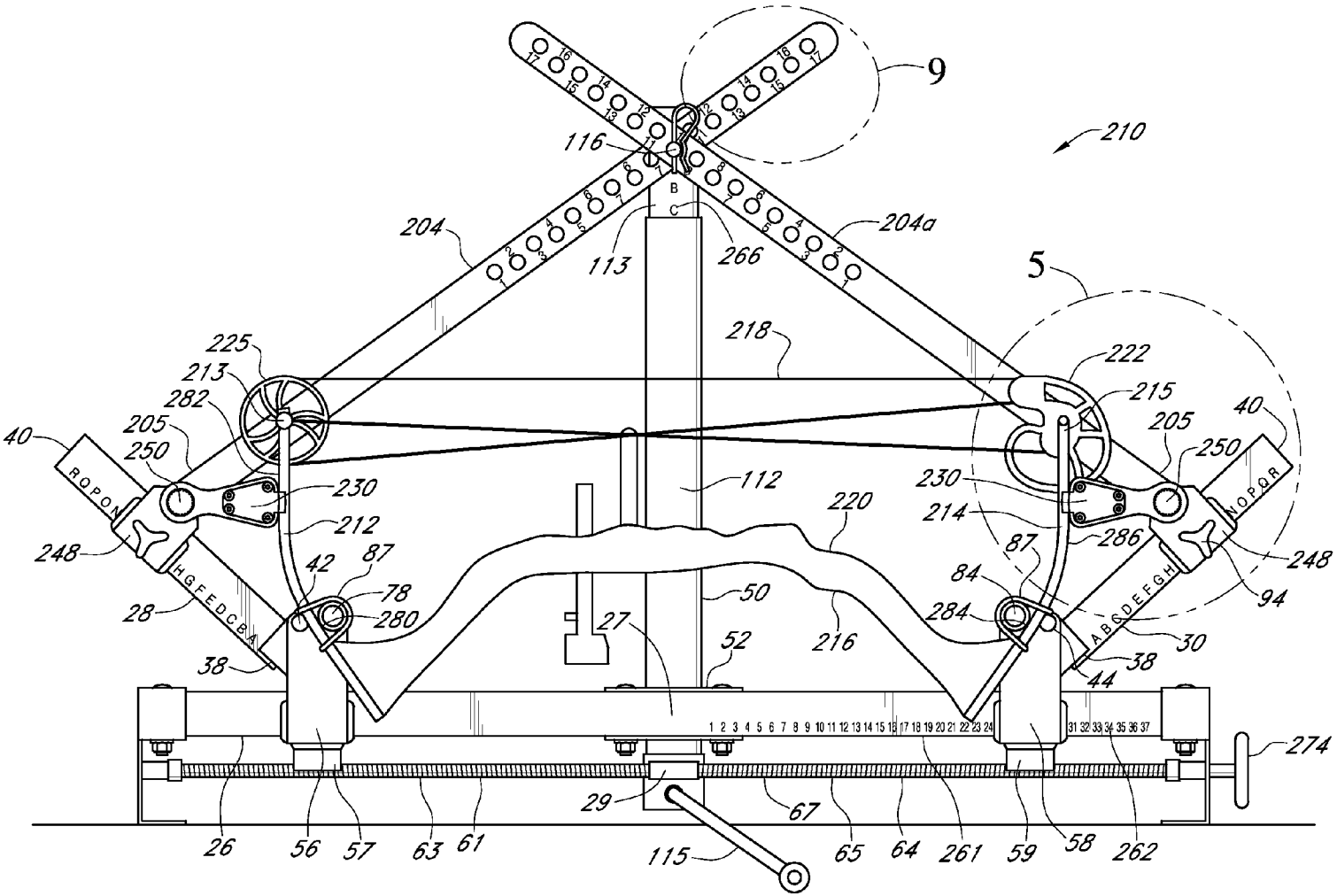
FIG. 4 is a front elevation of a second exemplary archery bow press for a short limbed bow according to the present invention.

FIGS. 4-8 illustrate another embodiment bow press which is useful for compressing short-limb bows or bows with limbs which almost parallel each other and extend at substantial angles from the longitudinal axis of the riser. FIG. 4 illustrates the invention bow press 210 according to the invention for deflecting the relatively short limbs 212, 214 of an archery bow 216 relative to the riser 220 thereof, to allow installation, replacement, repair or adjustment of a bow string 218 of the bow 216. The bow 216 includes a riser 220 from which limbs 212, 214 extend at substantial angles from the longitudinal axis of riser 220. The bow 216 includes a pulley 775 at the distal end 213 of limb 212 and a cam 222 at the distal end 215 of the limb 214.

Bow press 210 includes many identical parts to the bow press 10 of FIGS. 1-3 including an elongate main beam 26, first and second pivot arms 28, 30, and pivot arm brackets 56, 58 which retain the first and second pivot arms 28, 30 to the main beam 26. First and second pivot arms 28, 30 are adapted for supporting limb cradles 230 which may urge the limbs 212, 214 toward each other to relieve tension on the bow string 218.

The first and second pivot arms 28, 30 are spaced from one another along the main beam 26, with each of the first and second pivot arms 28, 30 having a hinged end 38 and a distal end 40. The pivot arm brackets 56, 58 are slidingly retained to the main beam 26.

The hinged end 38 of each pivot arm 28, 30 is attached by pivot arm bracket 56, 58 to the main beam 26, for pivoting motion about pivot axles 42, 44 which retain pivot arms 28, 30 to pivot arm bracket 56, 58, such that pivot arms 28, 30 move in a common plane with main beam 26.

An upstanding screw jack 50 is mounted to main beam 26 by mounting assembly 52 and extends upward perpendicularly from the main beam 26 at its midpoint 27.

An adjustment rod 64 generally parallel to main beam 26 is interconnected with each pivot arm bracket 56, 58 by screw followers 57, 59 such that simultaneous selective sliding movement of the first and second pivot arm brackets 28, 30 may be effected along the main beam 26, toward or away from the midpoint 27 of beam 26.

The adjustment rod 64 is retained to the main beam 26 by central bracket 29 which allows adjustment rod 64 to turn freely. Adjustment rod 64 is provided with screw threads therealong with the pitch of the threads 61 of the left end 63 reversed to the pitch of the threads of the right end 65, that is threads 61 may be right hand threads and threads 67 may be left hand threads, or vice versa. Adjustment rod 64 is operatively connected to the first and second pivot arm brackets 56, 58 such that both pivot arm brackets 56, 58 move at the same rates of travel along the main beam 26 though in opposing directions.

Located along first end 261 of beam 26 are spaced apart indicia 262, namely a series of numbers spaced apart evenly to mark locations along first end 261 of beam 26. Indicia 262 provide locations at which second pivot arm bracket 58 may be set, based on data collected by using bow press 210 to press various models of compound bows. For example, a given model of a bow will have a specific known length of its riser and data may be determined regarding the proper placement of second pivot arm bracket 58 and consequently the placement of first pivot arm bracket 56 to properly support that bow on bow press 210.

The embodiment of the bow press 210 of FIGS. 4-10 includes a first inside surface support 78 which may be a cushioned rod extending laterally forward from first pivot arm bracket 56, adapted for contacting an inside surface 280 the first limb 212 near its connection to the riser 220. The invention allows the first inside surface support 78 to be placed as close as possible to the connection of the first limb 212 to the riser 220, so that the bow 216 can bend in the bow press 210 about the interconnection of the first limb 212 and the riser 220. Similarly second inside surface support 84 contacts inside surface 284 of limb 214 near its connection to riser 220. Preferably inside surface supports 78, 84 are cushioned cylindrical rods extending laterally and perpendicular to main beam 26. Elastic bands 87 selectively are applied to bow 216 to retain bow 216 to inside surface supports 78, 84 so that bow 216 remains suspended from bow press 210.

The first inside surface support 78 is attached to the first pivot arm bracket 56 so that its axis is at a short fixed distance inboard of the first pivot axle 42, with respect to the midpoint 27 of beam 26. This closely adjacent but slightly inboard positioning of the first inside surface support 78 with respect to the pivot axle 42 of the first pivot arm 28, together with having both the first inside surface support 78 and first pivot axle 42 located at a fixed distance from one another on the first pivot arm support bracket 56, provides an advantageous arrangement for properly supporting the inside surface 280 of the bow 216 in a manner that allows the first limb 212 to flex during use of the bow press 210 in a manner that is very similar to the way the first limb 212 flexes when the bow 216 is in normal use.

The second inside surface support 84 is attached to the second pivot arm bracket 58 so that the axis of second inside surface support 84 is a short fixed distance inboard of the second pivot axle 44, with respect to the midpoint 27 of beam 26. This closely adjacent but slightly inboard positioning of the second inside surface support 84, with respect to the pivot axle 44 of the second pivot arm 30, together with having both the second inside surface support 84 and second pivot axle 44 located at a fixed distance from one another on the second pivot arm bracket 58, provides an advantageous arrangement for properly supporting the inside surface 284 of the limb 214 in a manner that allows the second limb 214 to flex during use of the bow press 210.

The bow press 210 further includes limb deflector bracket 248 slidingly attached to the pivot arms 28, 30 with a non rotatable support rod 250 extending horizontally from each limb deflector bracket 248, substantially perpendicular to main beam 26. Each support rod 250 is adapted for receiving a limb cradle 230 on splined segment 252 of support rod 250 (See FIG. 7) in order to allow each limb cradle 230 to contact an outside surface 282, 286 of limbs 212, 214. Each limb deflector bracket 248 includes a locking mechanism 94 (a set screw) for locking the limb deflector brackets 248 to the first pivot arm 28, 30 at a selected distance from the first pivot axles 42, 44 respectively.

Figure 7:
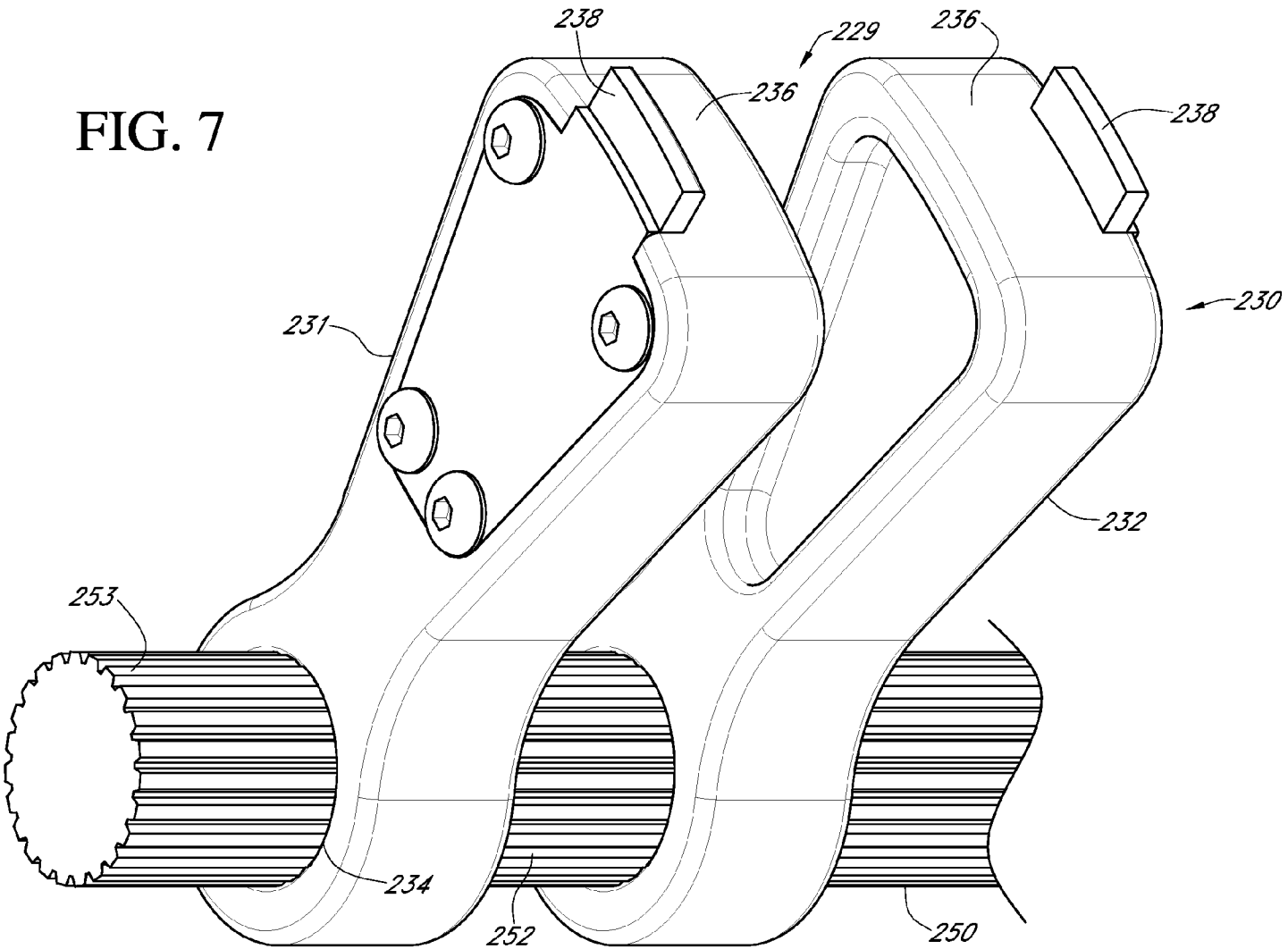
FIG. 7 is an enlarged perspective of the limb engaging cradle of the bow press of FIG. 4.

Referring additionally to FIGS. 5-8, details of the structure and location of limb cradles 230 may be better understood. As seen in FIG. 7, each limb cradle 230 includes a first limb engagement block 231 spaced apart from second limb engagement block 232 by a gap 229 sufficient to allow a cam 777 or pulley 225 to be received between them. The limb engagement blocks 231, 232 are preferably used in pairs and are identical but arranged so that plungers 238 are located at the outside of the limb cradle 230. Each limb engagement block 231, 232 receives a splined segment 252 of a support rod 250 within a cylindrical opening 234 of the limb engagement block which is fitted with receiving splines 235 such that engagement blocks 231, 232 may not rotate about splined segment 252 yet the pair of limb engagement blocks 231, 232 may be removed from splined segment 252 and reinstalled thereon at a different angular position or each engagement block 231, 232 each can be fitted on splined segment 252 at a different angular position from the other engagement block.

Preferably, engagement blocks 231, 232 are placed on splined segments 252 such that the bearing surface 236 of each engagement block 231, 232 tangentially touches the outside surfaces 282, 286 respectively of limbs 212, 214, and such that the plunger 238 of each limb engagement block 231, 232 is located at the opposing sides of limbs 212, 214 to prevent the limbs 212, 214 from sliding off bearing surfaces 236.

Figure 8:
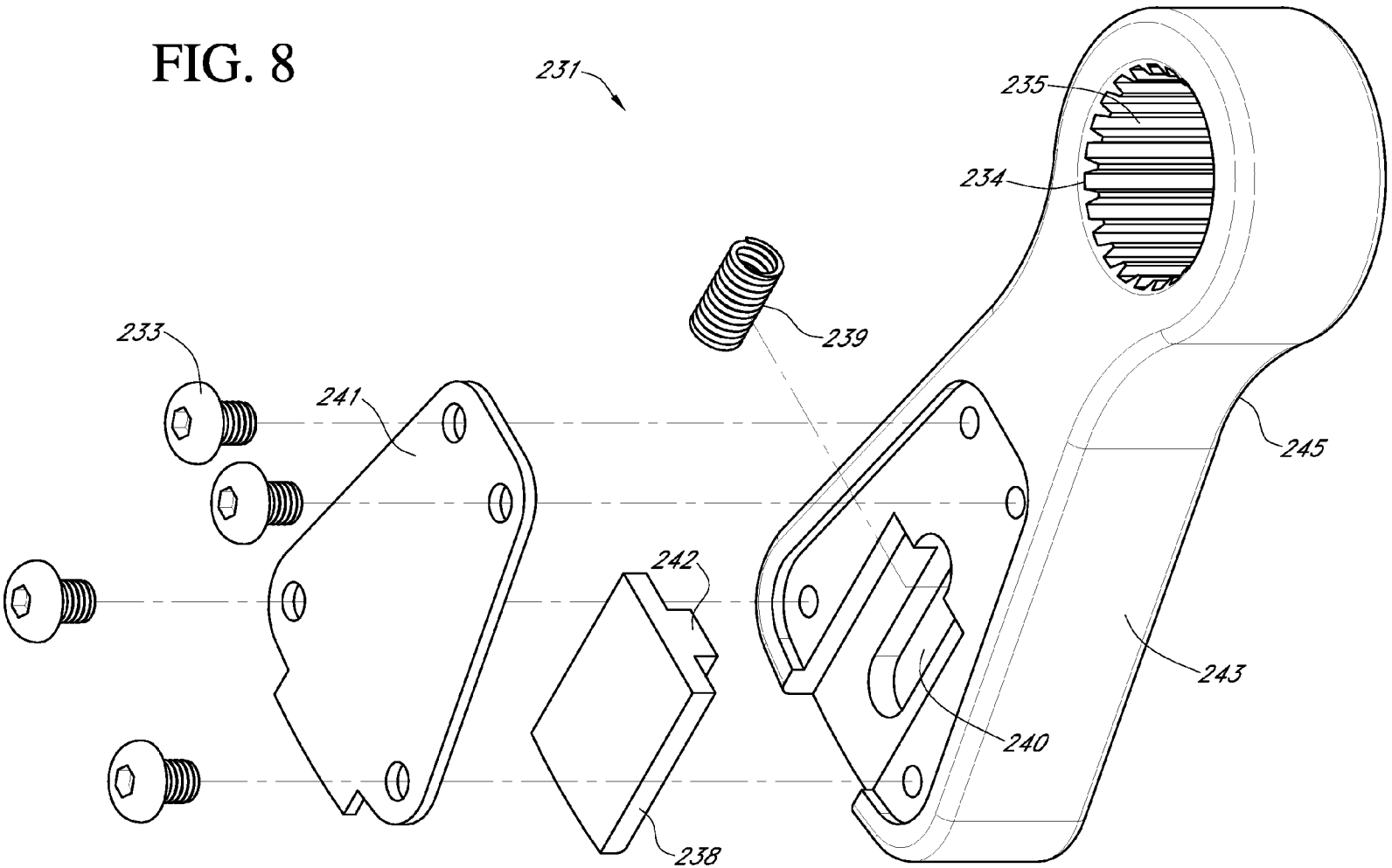
FIG. 8 is an exploded perspective of one of the limb engaging members of the cradle of FIG. 7.

FIG. 8 illustrates that plungers 238 of each engagement block 231, 232 are biased by a spring 239 which is received in a recess 240 and that stop element 242 rides in recess 240 to prevent plunger 238 from escaping from engagement block 231. A cover 241 is retained to body 243 of each engagement block 231, 232 by screws 233.

Cylindrical opening 234 of handle 245 of body 243 of each engagement block 231, 232 is populated with receiving splines 235 which mesh with splines 253 of splined segment 252 of support rod 250.

Figure 5:
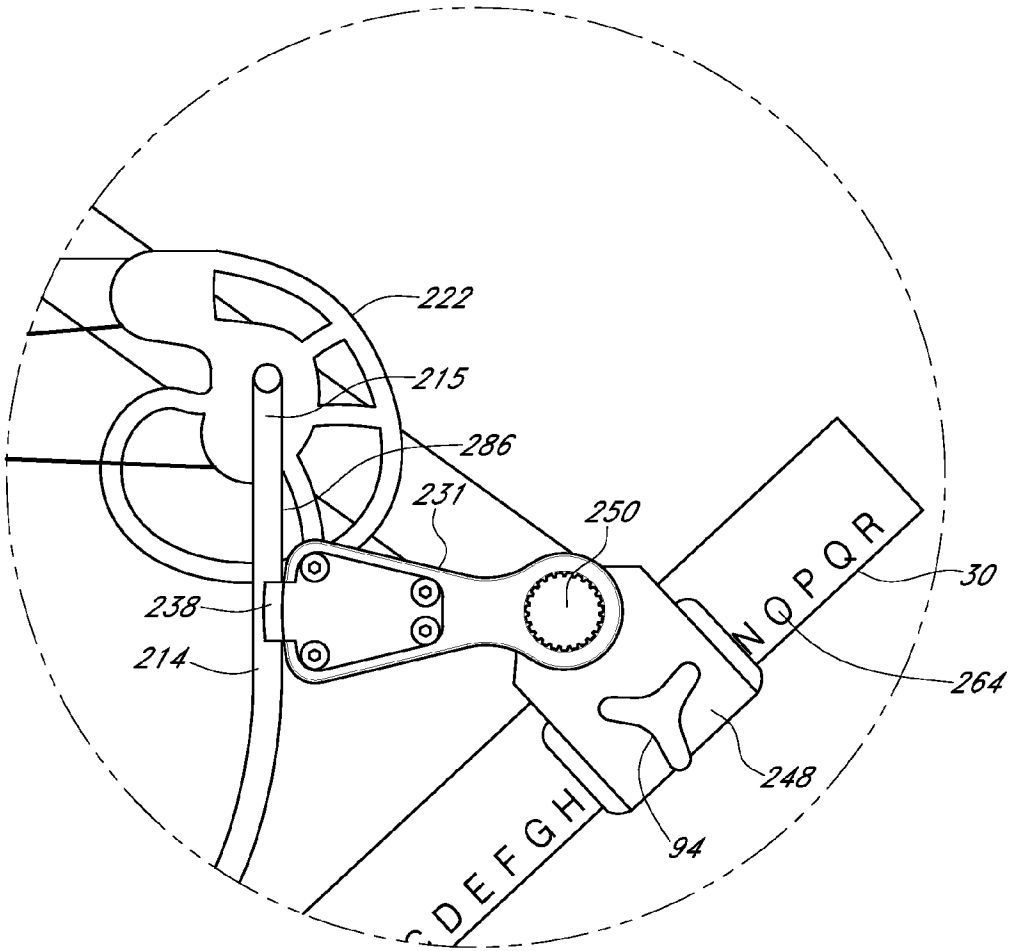
FIG. 5 is an enlarged view of the section of FIG. 4 marked as item 5.
Figure 6:
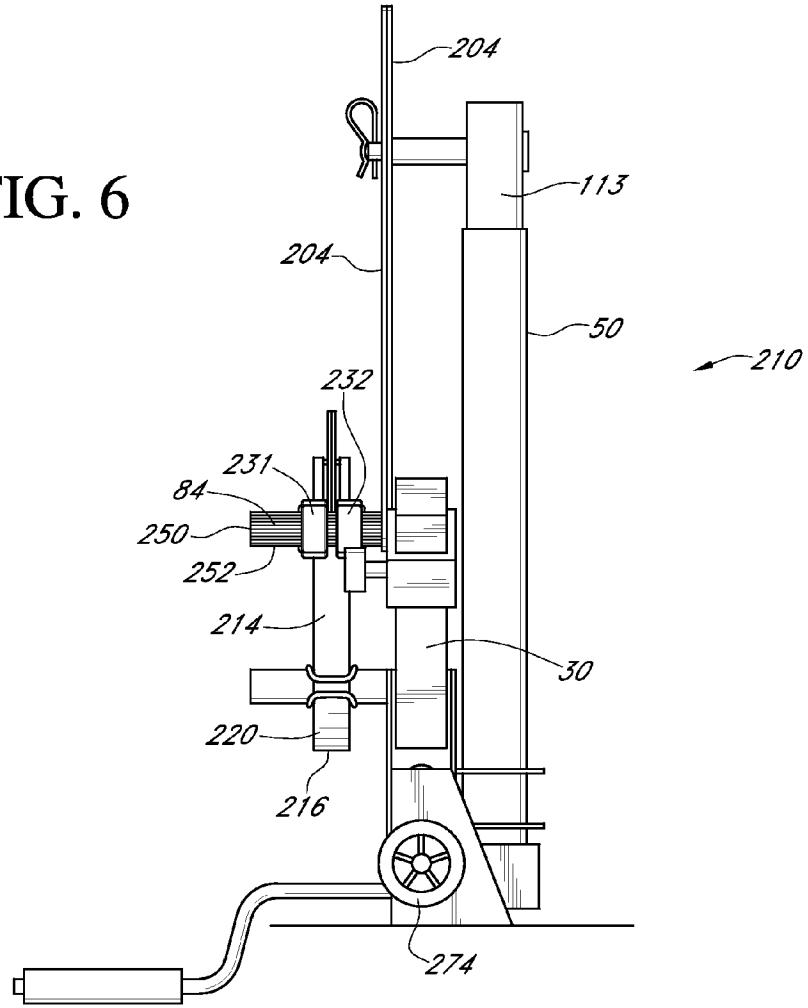
FIG. 6 is a side plan view of the bow press of FIG. 4.

As seen in FIG. 5, each pivot arm 28, 30 carries indicators 264, which in the example of FIG. 5, are spaced apart letters. As with the indicia 262 of beam 26, data may be compiled indicating the indicator 264 at which the limb deflector bracket 248 should be located for the specific bow model to be compressed.

Referring again to FIG. 4, it is seen that the bow press 210 further includes a screw jack 50 substantially centered on beam 26, as well as a pair of link members 204 joining limb deflection brackets 248 to extensible section 113 of screw jack 50. The screw jack 50 has a stationary section 112 attached to the main beam 26 of the bow press 10 by jack mounting brackets 52. Extensible section 113 telescopes from base section 112 of the screw jack 50. The screw jack 50 is attached to the main beam 26 at its midpoint 27 in such a manner that when first screw crank 115 is turned, the extensible section 113 of the screw jack 50 extends or retracts from base section 112.

Link members 204, 204*a* mirror each other, each having a first end pivotably attached respectively to the support rods 250 so that each link member 204 pivots freely with respect to pivot arms 28, 30. The link members 204 cross and are each removably joined to the other and to the extensible section 113 by a pin 116 mounted to and extending perpendicularly from the extensible section 113 of the screw jack 50.

Figure 9:
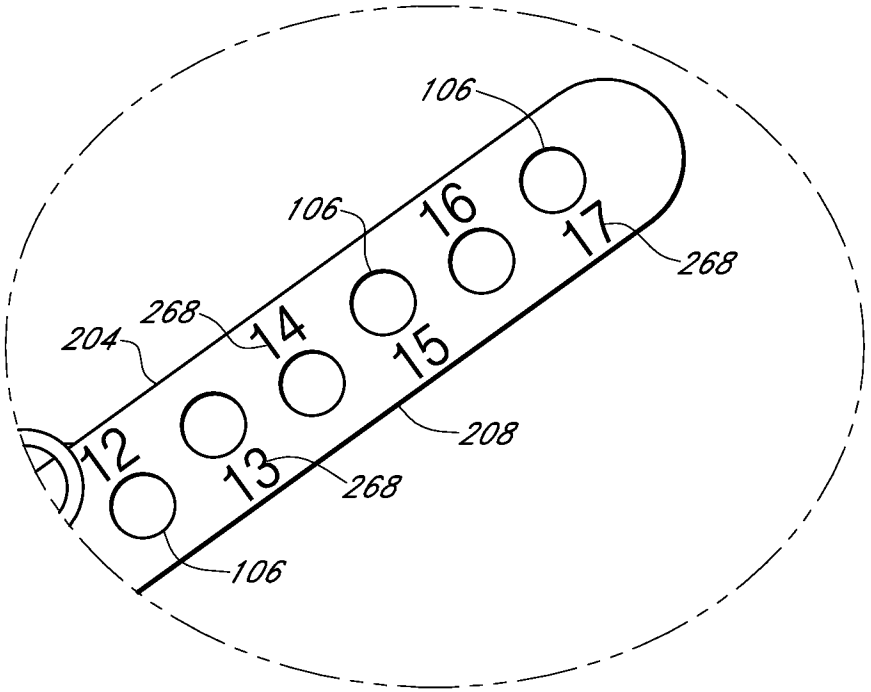
FIG. 9 is an enlarged front elevation of an end of one of the limb members of the bow press invention.

From examination of FIG. 9, it can be seen that adjustment end 208 of each link member 204, 204*a* is provided with a multiplicity of holes 106 with each hole 106 labeled with a label 268 such that the label 268 of the hole 106 furthest from first ends 205, 205*a* of each link member 204, 204*a* is the same for each link member 204, 204*a*. Therefore, the bow press 216 may be preset such that each link member 204, is attached to extensible member 113 through a hole 106 labeled the same on each link member 204, 204*a*.

The link members 204, 204*a* have equal effective lengths between their respective first ends 205 and the common connection provided by the pin 116. The screw jack 50 functions to raise and lower both pivot arms 28, 30 together thereby exerting force to support arms 250 and limb cradles 230 and hence applying bending force to the limbs 212, 214 of bow 216 mounted in the bow press 210.

It is to be observed that extensible section 113 of jack 50 is marked with indexing marks 266 such that once a bow 216 is in place on the bow press 210 with extensible section 113 retracted, the user may extend the extensible section 113 to a predetermined location as viewed by inspection of the indexing marks 266 on extensible section 113.

First end 140 of adjustment rod 64 is joined to a hand wheel 274 adapted to allow adjustment rod 64 to be rotated while the user is positioned in front of bow press 210. As adjustment rod 64 rotates, threaded couplers within each of screw followers 57, 59 are driven by opposing threads 61, 67 causing pivot arm brackets 56, 58 to converge or diverge at equal rates. Thus pivot arms 28, 30 are symmetrically adjusted to accommodate the length of a bow 216 to be pressed. Because the bow 216 to be pressed in bow press 210 must be supported by the user as the pivot arms 28, 30 are moved, having hand wheel 274 easily accessible by the holder of the bow 216 eases the chore of adjusting the bow press 210 to fit the bow 216 such that inside surface supports 78, 84 are positioned just outboard of the limb connections of limbs 212, 214 to riser 220. Then elastic straps 87 can be applied to suspend bow 216 from inside surface supports 78, 84.

FIG. 10 illustrates a data table 276 which may be used to look up the type of compound, short limbed bow to be compressed and to preset the location of pivot arm brackets 56, 58 along beam 26 by reference to cross referenced indicia in column 291. First, jack 50 is adjusted by extending extensible section 113 to the height according to the setting indicated in column 294 of table 276 for the particular bow 216 to be compressed. Then location of limb deflector brackets 248 along pivot arms 28, 30 may be preset by reference to alphabetic indicators in column 292 of table 276. The numbered hole 106 of link members 204, 204*a* to use to attach link members 204, 204*a* to extensible section 113 is determined by reference to numbers in column 293 of table 276. Then the bow 216 to be compressed may be placed on bow press 210 and retained thereto by elastic bands 87. Proper orientation of limb cradles 230 on splined section 252 of support rods 250 is then accomplished, such that bearing surfaces 234 of engagement blocks 231, 232 abut outside surfaces 282, 286 of limbs 212, 214.

The preferred embodiment according to the present invention is illustrated in FIGS. 11-17. Some of the parts of the preferred embodiment are common to the embodiment illustrated in FIGS. 1-3 and particularly to the embodiment illustrated in FIGS. 4-8. References to elements of the drawings throughout the ensuing description identify identical elements with the same reference numerals as used in earlier portions of this disclosure.

The bow press 310 shown in FIGS. 11-17 is useful for compressing archery bows for removal of bowstrings and especially useful for compression of short-limbed bows or bows with limbs which extend at large angles from the longitudinal axis of the bow riser and are almost parallel with each other. The invention disclosed in FIGS. 11-17 includes certain safety and efficiency enhancements which are described in the following paragraphs.

Figure 11:
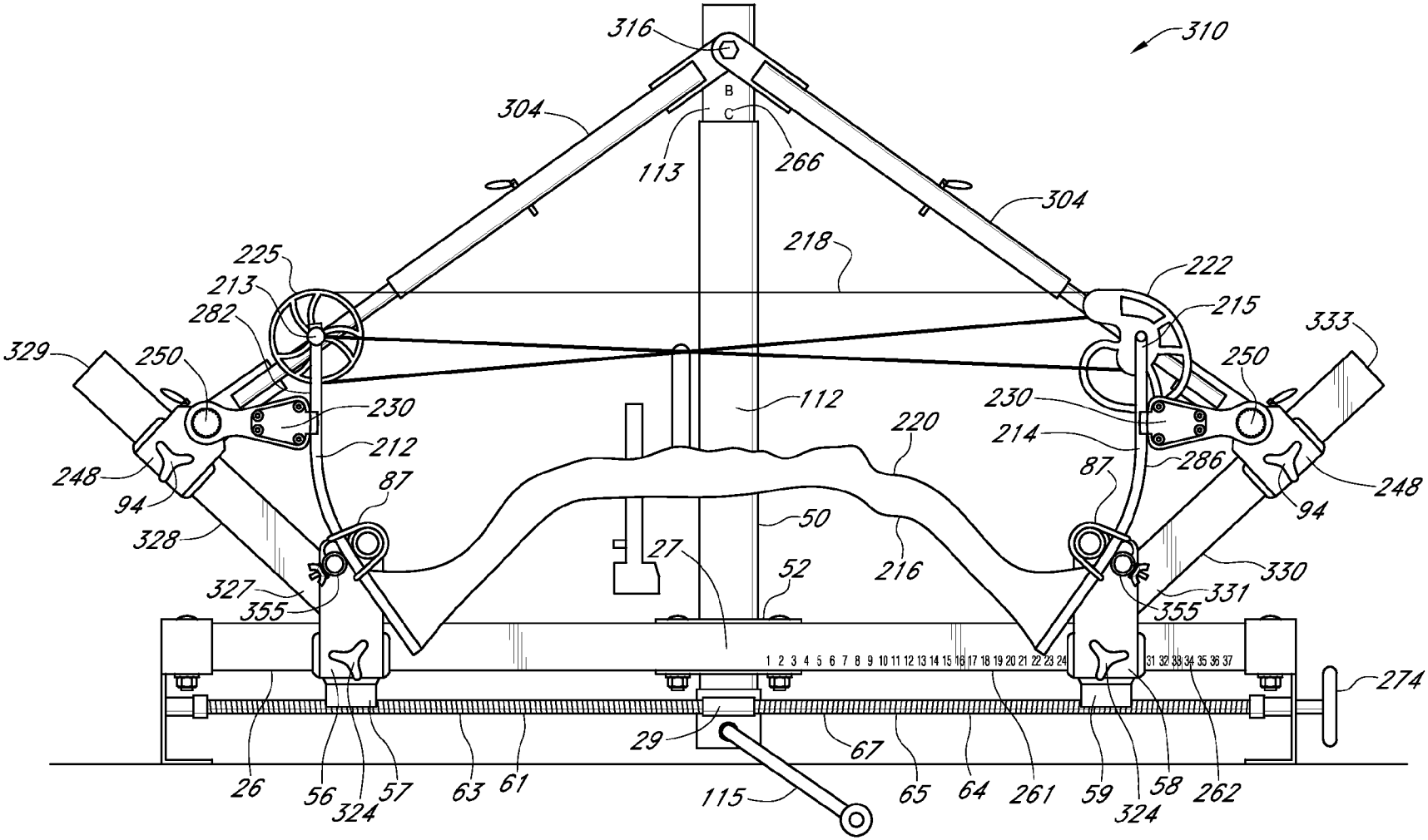
FIG. 11 is a front elevation of an improved bow press according to the present invention.

FIG. 11 illustrates the invention bow press 310 according to the instant invention with a compound archery bow 216 installed on the bow press 310 for purposes of deflecting the relatively short limbs 212, 214 of the bow 216 relative to the riser 220 thereof, to allow installation, replacement, repair or adjustment of a bow string 218 of the bow 216. The bow 216 includes a riser 220 from which limbs 212, 214 extend at substantial angles (at least seventy-five degrees) from the longitudinal axis of riser 220. The bow 216 includes a pulley 225 at the distal end 213 of limb 212 and a cam 222 at the distal end 215 of the limb 214.

Figure 12:
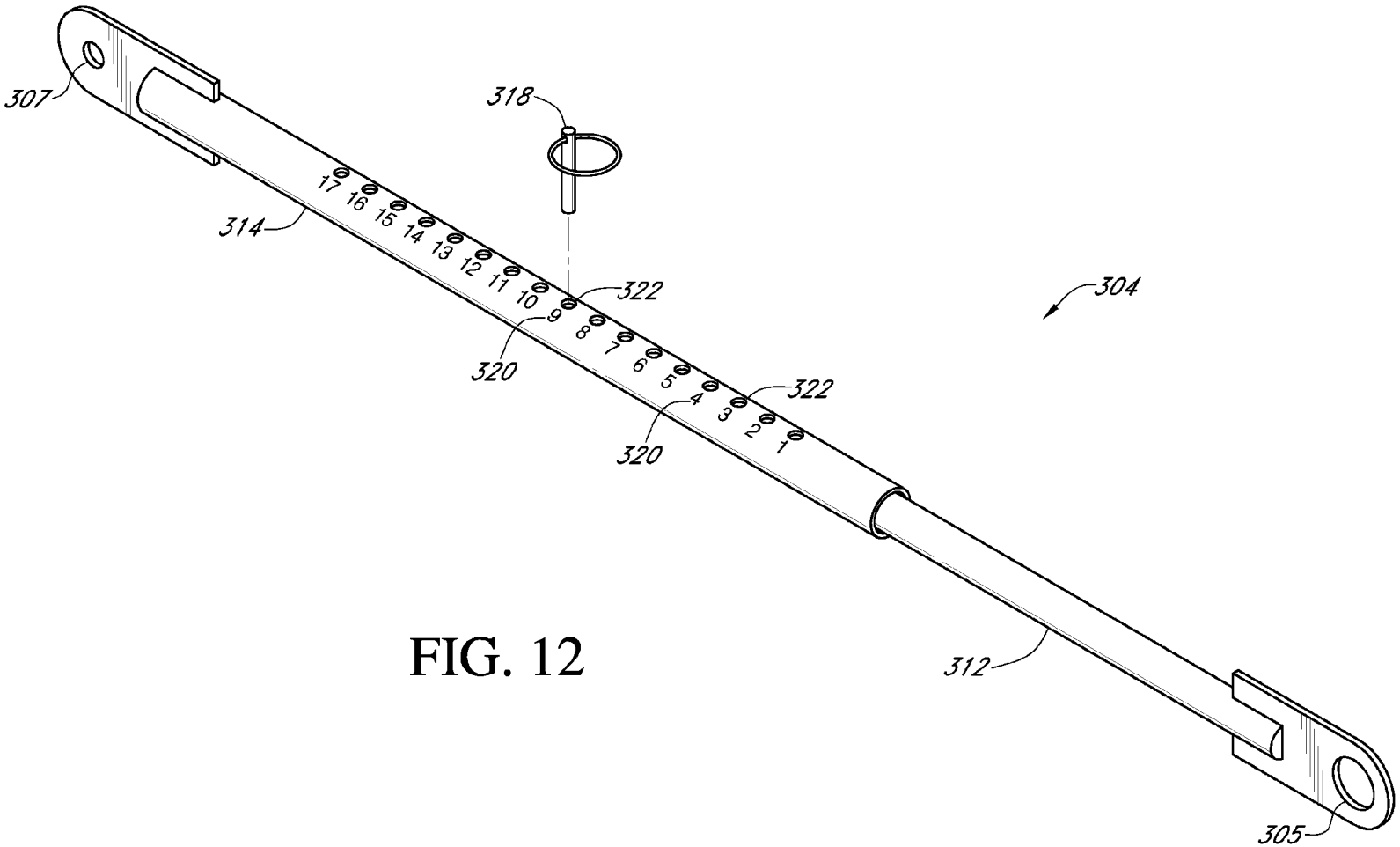
FIG. 12 is an enlarged perspective of one of the telescoping link members of the bow press of FIG. 11.
Figure 13:
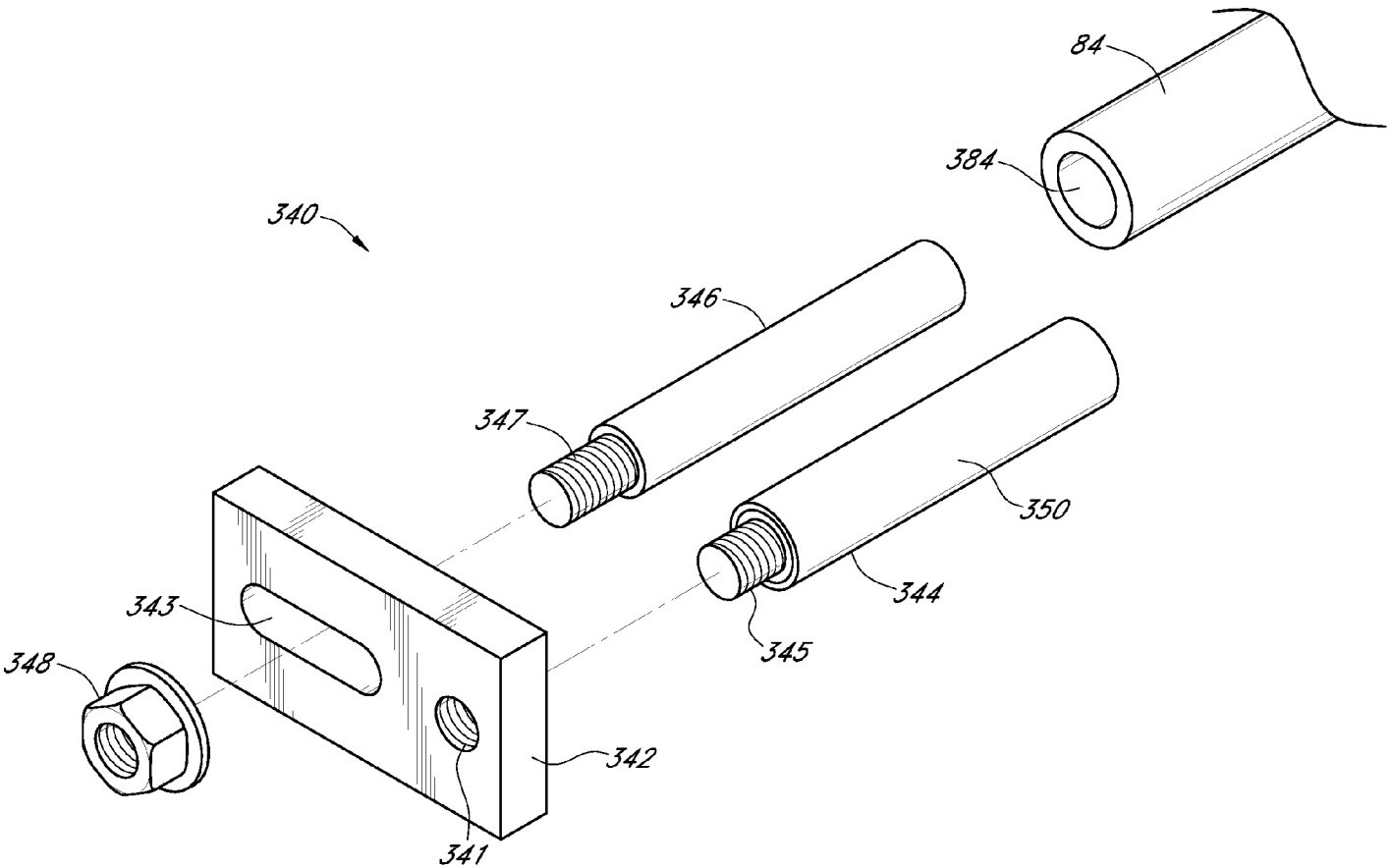
FIG. 13 is an exploded view in perspective of one embodiment of a limb retention member of the present invention.

Bow press 310 includes many identical parts to the bow press 210 of FIGS. 11-13 including an elongate main beam 26 supported on base 32, and pivot arm brackets 56, 58 which are moved together but in opposite directions by action of the threaded rod 64 when it is driven by hand wheel 274. An upstanding screw jack 50 is mounted to main beam 26 by mounting assembly 52 and extends upward perpendicularly from the main beam 26 at its midpoint 27.

Each of pivot arm brackets 56, 58 is coupled to a pivot arm 328, 330 respectively, the pivot arms 328, 330 being adapted for supporting limb cradles 230 which may urge the limbs 212, 214 toward each other to relieve tension on the bow string 218.

The first and second pivot arm brackets 56, 58 are slidingly retained to the main beam 26 and are spaced from one another along the main beam 26, essentially equidistantly from midpoint 27 of beam 26. Each of the first and second pivot arms 328, 330 has a hinged end 327, 331 hinged to a pivot arm bracket, 56, 58, and each has a distal end 329, 333. The hinged end 327, 331 of each pivot arm 328, 330 is attached by pivot arm bracket 56, 58 to the main beam 26, for pivoting motion about pivot axles 42, 44 (See FIGS. 4, 14) which retain pivot arms 328, 330 to pivot arm brackets 56, 58, such that pivot arms 328, 330 move in a common plane with main beam 26.

The adjustment rod 64 is generally parallel to main beam 26 of bow press 310 and is interconnected with each pivot arm bracket 56, 58 by screw followers 57, 59 such that simultaneous selective movement of the first and second pivot arms 328, 330 may be effected along the main beam 26, toward or away from the midpoint 27 of beam 26. After the brackets 56, 58 are positioned along beam 26 so that the ends of the riser 220 of the bow 216 can be supported by brackets 56, 58, lock knobs 324 may be used to maintain the positions of the brackets 56, 58 by impressing set screws against the beam 26.

Located along first end 261 of beam 26 are spaced apart indicia 262, namely a series of individual numbers or letters spaced apart evenly to mark locations along first end 261 of beam 26. Indicia 262 provide locations at which second pivot arm bracket 58 may be set, based on data collected by using bow press 310 to press various models of compound bows. For example, a given model of a bow will have a specific known length of its riser and based on that length, the proper placement of second pivot arm bracket 58 and consequently the placement of first pivot arm bracket 56 to properly support that bow on bow press 310 can be preset.

The embodiment of the bow press 310 of FIGS. 11-17 includes inside surface supports 78, 84 which may be cushioned rods extending laterally forward from pivot arm brackets 56, 58 respectively, adapted for contacting inside surfaces 280, 284 of the limbs 212, 214 near their connections to the riser 220. Each inside surface support 78, 84 therefore serves as a fulcrum for the limb it touches. The invention allows the inside surface support 78, 84 to be placed as close as possible to the connections of the limbs 212, 214 to the riser 220, so that the bow 216 will deflect in the bow press 310 about the interconnection of the limbs 212, 214 to the riser 220. Elastic bands 87 selectively may be applied to retain bow 216 to inside surface supports 78, 84 so that bow 216 may be suspended from bow press 310. Securing members 340 may be attached to the inside surface supports 78, 84 once the bow 216 has been suspended therefrom.

Each inside surface support 78, 84 is attached to the pivot arm bracket 56, 58 so that its axis is at a short fixed distance inboard of the first pivot axle 42, 42, with respect to the midpoint 27 of beam 26. This closely adjacent but slightly inboard positioning of the first inside surface supports 78, 84 with respect to the pivot axles 42, 44 provides an advantageous arrangement for properly supporting the inside surfaces 280, 284 of the limbs 212, 214 in a manner that allows the limbs 212, 214 to flex about inside surface supports 78, 84 during use of the bow press 310, in a manner that is very similar to the way the limbs flex when the bow 216 is in normal use.

First end 140 of adjustment rod 64 is coupled to a gear box 142 adapted to allow adjustment rod 64 to be rotated from a perpendicular direction. Specifically gear box 142 houses a spider gear which allows a second crank 118 to apply rotational force to crank coupling 144 of gear box 142 with the result that adjustment rod 64 rotates. As adjustment rod 64 rotates, threaded couplers within each of screw followers 57, 59 are driven by opposing threads 61, 67 causing pivot arm brackets 56, 58 to converge or diverge at equal rates. Thus pivot arms 328, 330 are symmetrically adjusted to accommodate the length of a bow 216 to be pressed. Because the bow 216 to be pressed in bow press 310 must be supported by the user as the pivot arms 328, 330 are moved, having a crank coupling 144 facing the holder of the bow 216 eases the chore of adjusting the bow press 310 to fit the bow 216 such that inside surface supports 78, 84 are positioned just outboard of the limb connections of limbs 212, 214 to riser 220. Then elastic straps 87 can be applied to suspend bow 216 from inside surface supports 78, 84.

Importantly, gear box 142 at first end 140 of adjustment rod 64 permits rotation of adjustment rod 64 by a user using second crank 118 to rotate the crank coupler 144 while standing in front of bow press 310 and holding bow 216. This allows the user to easily reposition the pivot arm brackets 56, 58 while suspending the bow 216 with one hand until the separation of pivot arm brackets 56, 58 is appropriate so the bow limbs 212 and 214 are supported properly.

As adjustment rod 64 rotates, threaded couplers within each of screw followers 57, 59 are driven by opposing threads 61, 67 causing pivot arm brackets 56, 58 to converge or diverge at equal rates. Thus pivot arms 328, 330 are symmetrically adjusted to accommodate the length of the riser 220 of a how 216 to be pressed. Because the bow 216 to be pressed in bow press 310 must be supported by the user as the pivot arms 328, 330 are moved, having hand wheel 274 easily accessible by the holder of the bow 216 eases the chore of adjusting the bow press 310 to fit the bow 216 such that inside surface support members 78, 84, which as serve as fulcrums, are positioned just outboard of the limb connections of limbs 212, 214 to riser 220. Then elastic straps 87 can be applied to suspend bow 216 from inside limb support fulcrum members 78, 84.

The bow press 310 further includes a limb deflector bracket 248 slidingly retained to each of the pivot arms 328, 330. A non rotatable support rod 250 extends horizontally from each limb deflector bracket 248, the support rods 250 being substantially perpendicular to main beam 26. Each support rod 250 is adapted for receiving a limb cradle 230 on a splined segment 252 of support rod 250 in order to orient each limb cradle 230 to contact an outside surface 282, 286 of limbs 212, 214 respectively. Each limb deflector bracket 248 includes a locking mechanism 94 for locking the limb deflector bracket 324 to the respective one of the pivot arms 328, 330 at a selected distance from the first pivot axle 42, 44 respectively.

Figure 14:
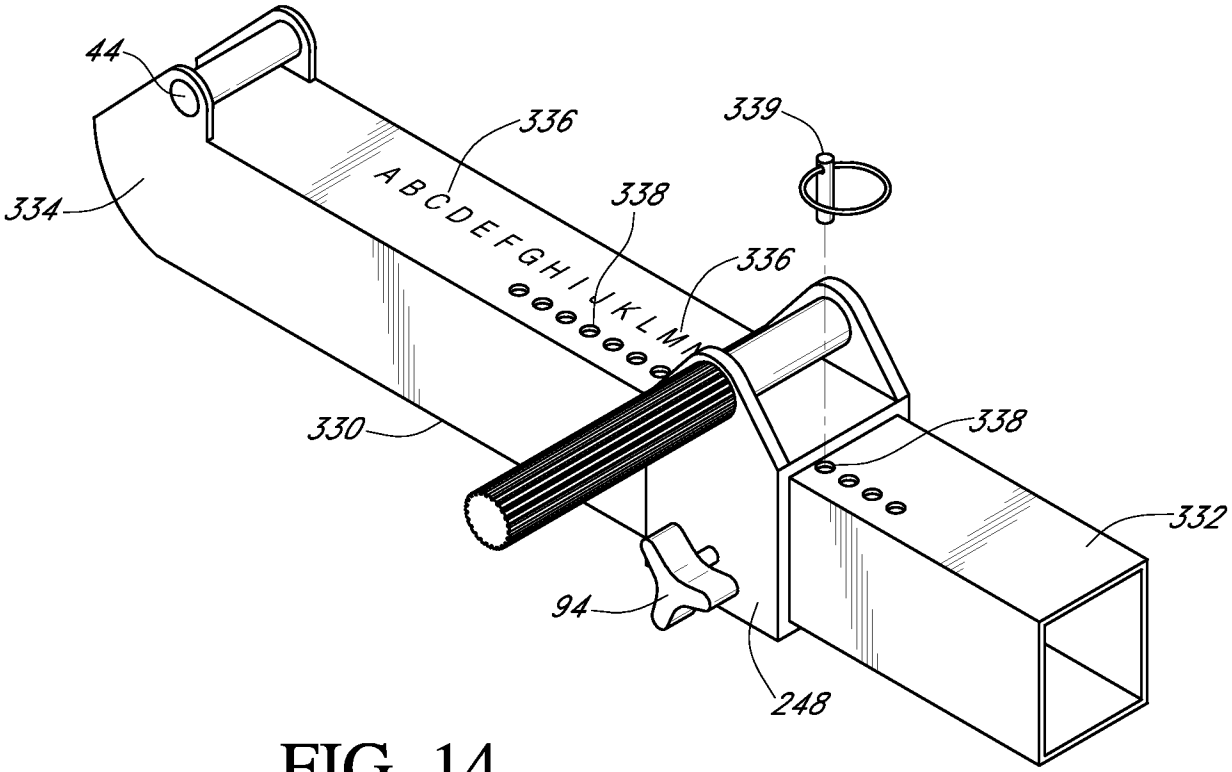
FIG. 14 is an enlarged perspective of a right-hand one of the pivot arms of the present invention, with a pivot arm bracket is place along the pivot arm.

As seen in FIG. 14, each pivot arm 328, 330 carries location markings 336, which in the embodiment of FIG. 14, are spaced apart letters. Location markings 336 correspond with holes 338 on pivot arms 328, 330. As with the indicia 262 of beam 26, data may be compiled indicating a specific location marking 336 at which the limb deflector bracket 248 should be located for the specific bow model to be compressed.

The locking mechanism in the preferred embodiment shown in FIG. 11 is illustrated in detail in FIG. 14 wherein right hand pivot arm 330 is shown hinged to pivot arm bracket 58. The user will position limb deflector bracket 248 such that engagement block 230 will abut the outside surface 286 of limb 214 in an appropriate location, as seen in FIG. 11. Lock knob 324 is then tightened to hold limb deflector bracket 248 in place. Lock knob 324 may be a set screw. A drop in pin 374 may be used to prevent the limb deflector bracket 248 from moving outward along the length of pivot arm 330 if the friction created by lock knob 324 is overcome. A series of location markers 336 along the top surface 332 of pivot arm 330 provides an index of placement of the limb deflector bracket 248 along pivot arm 330 such that the other limb deflector bracket 248 retained to the pivot arm 328 may be set at the same location therealong. Drop in pins 374 are placed in the opening 338 of pivot arms 328, 330 which is adjacent to the edge of the limb deflector bracket 248 farthest from pivot end 327, 331 thereof.

It can also be seen in reference to FIG. 14 that pivot arm 330 may be a hollow box tube and that it is formed such that its hinged end 334 is retained to pivot arm bracket 58 by a pivot axle 44 such that pivot arm 330 may swing about pivot axle 44 in a plane which includes the beam 26 and the other pivot arm 328. It is to be understood that pivot arms 328 and 330 are mirror images of each other and are marked with locations markings 336 similarly, such that when the limb deflector bracket 248 slidable along pivot arm 330 is placed at a position marked "R" for instance, its counterpart on pivot arm 328 will also be placed at position "R". In each case the limb deflector bracket 248 is then locked in place along the respective pivot arm 328, 330 at the same relative distance from the pivot pin 42, 44. Therefore, each limb deflector bracket 248 can be placed at the proper location for the type or model of bow to be pressed, by reference to a cross reference table, such as that of FIG. 16.

Figure 15:
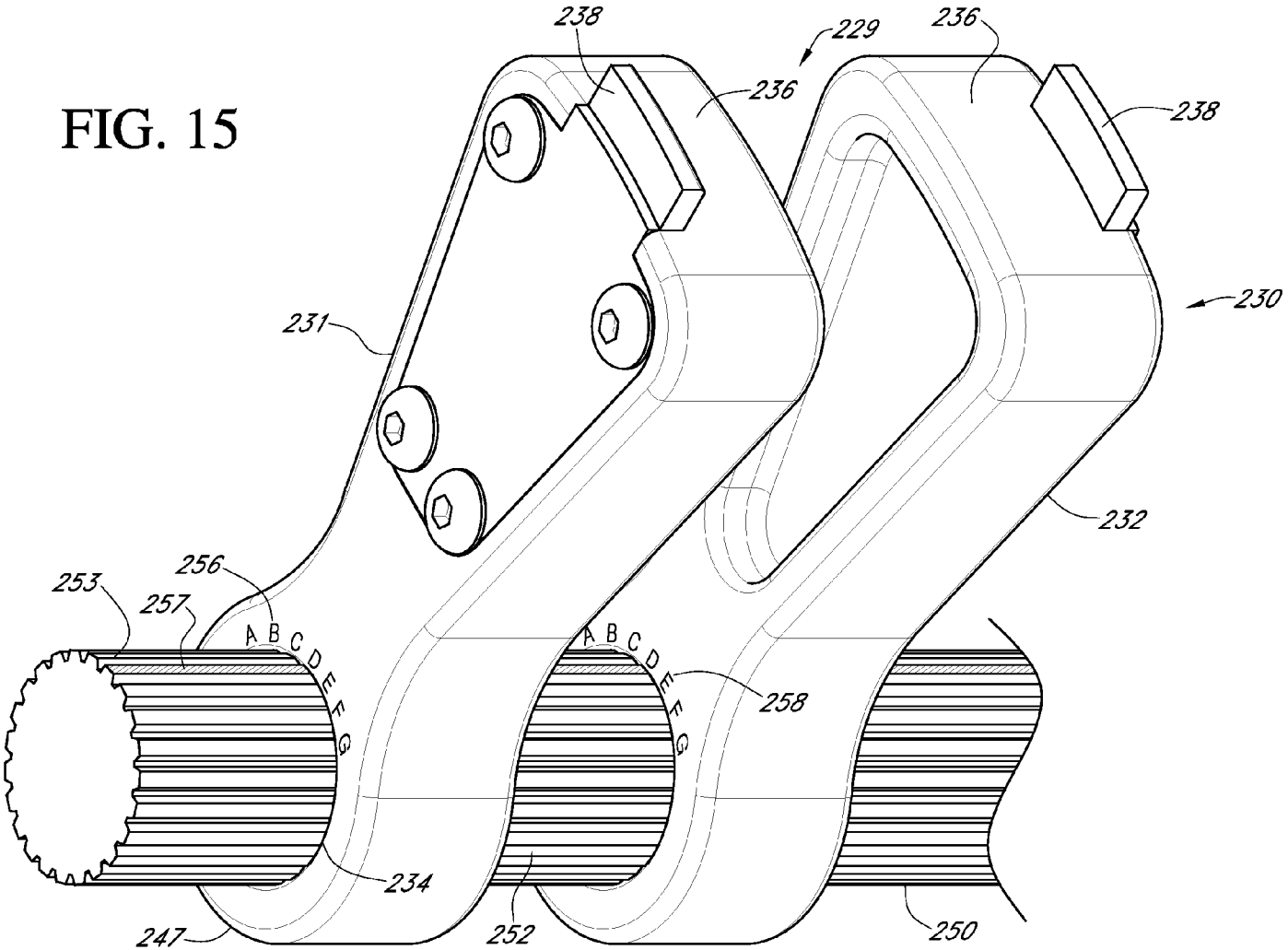
FIG. 15 is an enlarged perspective of the preferred embodiment of the limb cradles of the present invention, showing the indexes on the limb engagement blocks and the index spline on the splined support rod.

Referring now to FIG. 15, details of the structure and location of limb cradles 230 used on bow press 310 may be better understood. Each limb cradle 230 includes a first limb engagement block 231 spaced apart from second limb engagement block 232 by a gap 229 sufficient to allow a cam 222 or pulley 225 to be received between them. The limb engagement blocks 231, 232 are preferably used in pairs and are essentially identical (except for location of index indicators 258 thereon) but arranged so that plungers 238 thereof are located at the outside edges of the limb cradle 230. Each limb engagement block 231, 232 receives a splined segment 252 of a support rod 250 within a cylindrical opening 234 of the limb engagement block 231, 232, the cylindrical opening 234 being populated with receiving splines 235 such that engagement blocks 231, 232 may not rotate about splined segment 252 yet limb engagement blocks 231, 232 may be removed from splined segment 252 and reinstalled thereon at alternative angular positions, or each limb engagement block 231, 232 may be reinstalled at a differing angular position depending on the needs to accommodate various styles of bow limbs. Bow press 310 can accommodate traditional archery bows which have limbs more aligned with the axis of the risers thereof, by rotating the engagement blocks 231, 232 sufficiently such that rounded end 247 engages the outer surfaces of the bow limbs.

Preferably, limb engagement blocks 231, 232 are placed on splined segments 252 such that the bearing surface 236 of each engagement block 231, 232 will tangentially engage the outside surface 282, 286 of limbs 212, 214 respectively, and such that the plunger 238 of each limb engagement block 231, 232 will be located at the opposing sides of limbs 212, 214 to prevent the limbs 212, 214 from sliding off bearing surfaces 236.

Referring back to FIG. 8, as seen and described in reference to that figure, plungers 238 of each engagement block 231, 232 are biased by a spring 239 which is received in a recess 240. Stop element 242 rides in recess 240 to prevent plunger 238 from escaping from engagement block 231. A cover 241 is retained to body 243 of each engagement block 231, 232 by screws 233.

Referring once more to FIG. 15, a set of orientation index indicators 256 is marked on each engagement block 231, 232 near the cylindrical opening 234 thereof. An index spline 257 of the splines 253 surrounding splined part 252 of support rod 250 is permanently marked by color or by other identifying means such as by a nib or recess formed on the end of support rod 250. The alignment of index spline 257 relative to index indicators 256 may be noted and used for the limb cradles 230 on the opposing side of the bow press 310, and additionally may be retained in a compilation such as the data table shown in FIG. 16.

From use of bow press 310 on varying models and makes of bows, the proper orientation of engagement blocks 231, 232 on support rod 250 may be determined for each model or type of bow 216 to be compressed on the bow press 310. That information can be entered in a reference table such as table 356 which is exemplified in FIG. 16.

Referring again to FIG. 11, it is seen that the bow press 310 further includes a pair of link members 304 joining limb deflection brackets 324 to extensible section 113 of screw jack 50. Extensible section 113 telescopes from base section 112 of the screw jack 50 in such a manner that when first screw crank 115 is turned, the extensible section 113 of the screw jack 50 extends or retracts from base section 112.

Link members 304 are identical, each having a first end 306 pivotably attached to the limb deflector bracket 248 and specifically to the support rod 250 carried on the limb deflector bracket 248 of each pivot arm 328, 330. Each of link members 304 is irremovably retained to the extensible section 113 of jack 50 by a bolt 316 or other suitable fastener which allows the link members 304 to rotate about their connection to extensible section 113 as the extensible section 113 is raised or lowered. Because the link members 304 are selectively adjustable as to length without having to remove their connections at either end thereof, adjustment of the bow press 310 is facilitated and the potential for injury from slippage of a link from a removable mooring on the jack stand extendible section 113 is removed.

FIG. 12 illustrates each of link members 304 in more detail. Link member 304 includes an outer tube 314 and inner tube 312 and opposing ends 306, 308. Opening 305 of each inner tube 312 receives one of the support rods 250. Opening 307 receives bolt 316 of extensible member 113. A lock pin 318 secures outer tube 314 to inner tube 312 at a selected extension of inner tube 312 from outer tube 314. Each link member 304 will be adjusted to the same length, and location markings 320 on the outer tube 314 provide references to specific receiving openings 322 for making each of the link members 304 the same length, and in addition to allow the bow press 310 to be pre-adjusted for the make and model of the bow 216 to be pressed.

The link members 304 are adjusted so that each support rod 250 is equally distant from bolt 316 on jack 50. The screw jack 50 functions to raise and lower both pivot arms 328, 330 together thereby exerting force on both support arms 250 and limb cradles 230 and hence applying bending force to the limbs 212, 214 of bow 216.

It is to be observed that extensible section 113 of jack 50 is marked with indexing marks 266 such that the user may set the extensible section 113 to a predetermined location as viewed by inspection of the indexing marks 266 on extensible section 113. The location may be obtained from a chart listing makes and models of bows, such as FIG. 16 illustrates.

FIG. 16 illustrates a reference table 356 which may be used to look up settings for the parts of the bow press 310 which adapt the bow press 310 for a particular make or model of bow. In column 358 the particular compound, short limbed bow to be compressed is listed. The starting location for the extensible section 113 of jack 50 is provided in column 360 opposite the particular bow listed in column 358. The placement of pivot arm bracket 58 (and resulting placement of pivot arm bracket 56) along beam 26 may be determined by reference to data in column 362. Then location of limb deflector brackets 324 along pivot arms 328, 330 may be preset by reference to data from column 364 of table 356. The receiving openings 322 to be employed to set the length of link members 304 is determined by reference to column 368 of table 356. Proper orientation of limb cradles 230 on splined sections 252 of support rods 250 is then accomplished by looking up the proper setting in column 366 corresponding to the bow model listed in column 358. Orientation of limb cradles 230 is made such that bearing surfaces 234 of engagement blocks 231, 232 will properly abut outside surfaces 282, 286 of limbs 212, 214 when the bow press 310 is operated. Once these settings are made, the bow 216 may be placed on bow press 310 and retained thereto by elastic bands 87.

Before the bow press 310 is operated and particularly when a bow 216 having solid limbs is to be compressed, a limb securing member 340 may be temporarily attached to each inside surface support 78, 84. FIG. 13 shows an enlargement of a securing member 340 in exploded view. Securing member 340 includes a planar base element 342 to which are attached a fixed pin 344 and a movable pin 346. Fixed pin 344 is secured to base element 342 by inserting the threaded end 345 thereof into threaded opening 341 of base element 342. The threaded end 347 of adjustable pin 346 is received in slotted hole 343 of base element 342 and may be selectively secured in a spaced apart relationship to fixed pin 344 by locknut 348. However, second abutment pin 346 is not secured to base element 342 until placement of the securing members 340 on bow press 310.

The securing member 340 is removably attached to each inside surface support 78, 84 to serve to secure the bow 216 to the press 310, specifically by preventing the limbs 212, 214 from being able to slide downward between the limb cradles 230 when the limbs 212, 214 have been forced to flex toward one another. For example, inside surface support 84 of second pivot arm bracket 58 includes a coaxial bore 384 into which one of either fixed pin 344 or adjustable pin 346 may be inserted by sliding the pin into the bore 384. Thereafter the adjustable pin 346 is moved toward fixed abutment pin 341 until the outer surface 282 or 286 of respective limb 212, 214 is gently abutted by the one of the pins not inserted into the bore 384 of the inside surface support 84. At that point, the adjustable pin 346 is locked in position on base element 342 by tightening the locknut 348. Preferably, fixed pin 344 is covered by a cushioning sleeve 350 or alternatively coated with a resilient coating along its unthreaded portion 349 so that it will not mar the outside surface 282 of the limb 214 it engages. Adjustable pin 346 is preferably left uncoated so it can be slid easily into the coaxial bore 384 of the inside surface support 84. Then the base 342 slides along adjustable pin 346 until fixed pin 344 is touching or almost touching the outside surface of the limb 214. The lock nut is then tightened to retain the adjustable pin 346 to the base 342 so that the fixed pin 344 remains touching or very nearly abutting the outside surface of the limb 212, 214. A securing member 340 is attached to inside surface support 78 in a similar manner.

Figure 17:
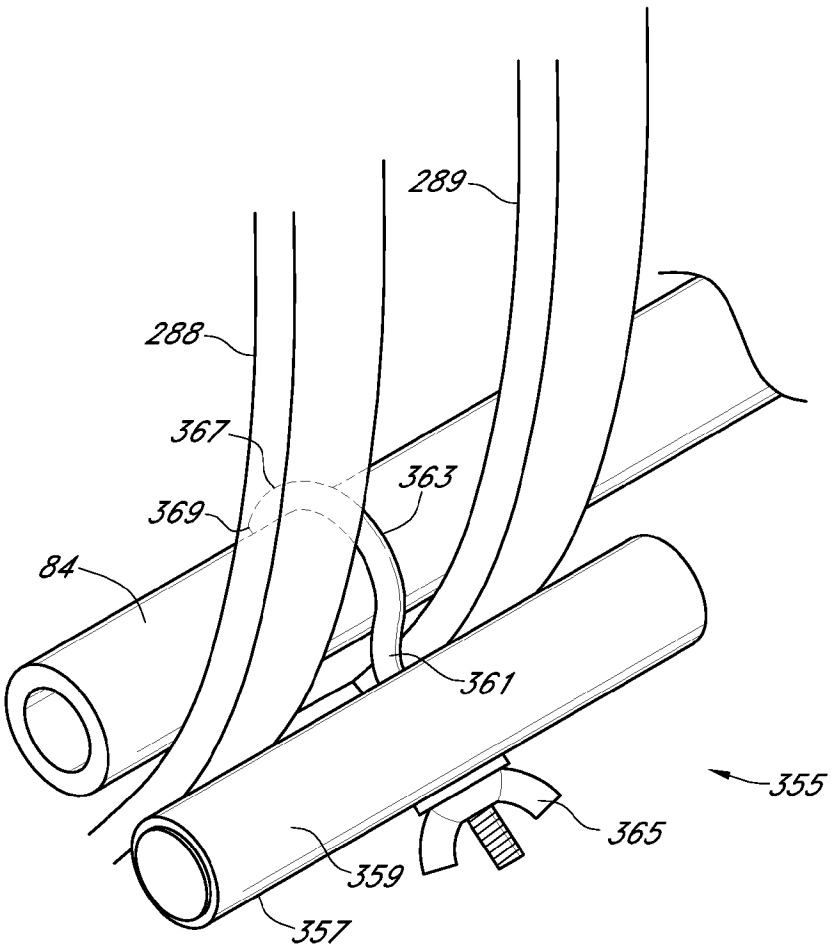
FIG. 17 is an enlarged perspective of a second limb retention element particularly useful when a split limb bow is to be compressed in the bow press.

In the case of a split limb bow to be compressed, alternate limb safety latches (limb retention members 355) as seen in FIG. 17 may be used. Limb retention members 355, positioned to pass between the limb elements 288, 289 of each limb 212, 214, provide very secure retention devices to prevent a short-limbed bow 216 from unexpectedly snapping downward from the bow press 310 when compression of the bow limbs 212, 214 is applied by the limb engagement blocks 231, 232.

FIG. 17 discloses an exemplary limb retention member 355 which is an alternative to the securing member 340 shown in FIG. 13 which is used when a solid limb bow is to be compressed. Limb retention member 355 comprises a bar element 357 selectively retained to a hook element 363 which includes a curved hook segment 367 and a shank segment 361. Shank segment 361 is narrow enough to pass between split limb elements 288, 289 of each limb 212,214 so that the hook element 363 can be hooked to the first or second inside support rod 78, 84 of the pivot arm brackets 56, 58 which is nearest the respective limb 212, 214. An adjusting element, e.g, wing nut 365, allows the bar element 359 to be moved along shank segment 361 and cinched up against the outside surfaces 286 of the split limb elements 288, 289 once the hook element 363 has been placed over second inside support rod 84 which is adjacent the limb 214. Likewise another limb retention member 355 is used to secure the limb 212 to first inside support rod 84.

The free end 369 of the hook segment 363 extends only a small distance past the apex 367 of the hook segment 363, that is, about fifteen to twenty degrees past the apex 367, in order avoid the potential for abutment of the free end 369 against the riser 220 when the bow 216 is fully compressed. The free end 369 of the hook segment 363 may be truncated along a line inclined approximately fifteen degrees from the longitudinal axis of the shank segment 361. The shank segment 361 is threaded so that the wing nut 365 can be used to draw the bar member 357 toward the rod 84. Because the limb retention member 355 serves to prevent downward motion of the limb 214 relative to the second inside support rod 84, it needs only to be snug against the limb segments 288, 289 but need not urge the limb segments 288, 289 toward the inside support 84. Therefore the wing nut 365 needs only to be moved a modest amount to allow the hook element to grasp (or release) the rod 84. It is obviously preferable for the hook element 367 to approximate the diameter of the rod 84 it is meant to partially surround.

Bar member 357 is preferably constructed of cylindrical rod stock and is surrounded by a cushioning sleeve 359 which may be constructed of nylon or other low friction polymer.

OPERATION OF THE INVENTION

In preparation for use of the bow press 310 for a particular short limbed, compound bow 216, the jack 50 is adjusted to a starting position by lowering extensible section 113 to the height according to the indexing mark 266 observed in column 364 of table 356 for the particular model of bow 216. Then placement of the pivot arm brackets 56, 58 is set along beam 26 by turning of the threaded rod 64, according to the location information in column 358. This positioning of the pivot arm brackets 56, 58 arranges the inside surface supports 78, 84 to be located at the junctions of the riser 220 with the limbs 212, 214. The pivot arm brackets 56, 58 are frictionally locked to the beam 26 by lock knobs 324. Then pivot arms 328, 330 are lowered by removing the drop in pins 318 from link members 304 to allow link members 304 to extend until pivot arms 328, 330 rest upon beam 26. Then the location of each limb deflector bracket 248 along pivot arms 328, 330 is set by reference to data in column 360 of Table 356. Lock elements 94 (set screws) are tightened slightly to maintain the locations of limb deflector brackets 248. Lock pins 339 are placed in the appropriate holes 338 of pivot arms 328, 330 such that the limb deflector brackets 248 cannot move outward along pivot arms 328, 330. The limb engagement blocks 231, 232 are then oriented on support rods 250 by reference to data in column 364 such that the index splines 257 are aligned with index indicators 258 on the limb engagement blocks 231, 232. Then, the pivot arms 328, 330 are raised manually and the lengths of link members 304 are set according to data from column 362, thereby drawing the pivot arms 328, 330 upward so that limb cradles 230 approach or gently abut limbs 212, 214. When the compound bow is equipped with solid limbs, securing members 340 may be applied to the inside surface supports 78, 84 thereby capturing the bow 216 to the bow press 310. In the case where the limbs 212, 214 are of the split-limb variety, then retention members 355 are applied to lock each limb 212, 214 to the respective inside surface support 78, 84.

After the bow 216 is fitted to the bow press 310, jack 50 may be adjusted by extending extensible section 113 to a sufficient height so that tension on the bow string 218 is released and the bow string 218 and other parts of the bow may be serviced or adjusted.

When servicing of the bow 216 is complete, the extensible section 113 is lowered to relieve compression forces on the limbs 212, 214 and the securing members 340 are removed after the locknuts 349 thereof are loosened to the extent that the second abutment pin 346 may slide along slotted hole 343 away from fixed abutment pin 344.

The foregoing description of the invention has been presented for purposes of illustration and description and is not intended to be exhaustive or to limit the invention to the precise form disclosed. Modifications and variations of the embodiments are possible in light of the above disclosure or such may be acquired through practice of the invention. The embodiments illustrated were chosen in order to explain the principles of the invention and its practical application to enable one skilled in the art to utilize the invention in various embodiments and with various modifications as are suited to the particular use contemplated. It is intended that the scope of the invention be defined by the claims appended hereto, and by their equivalents.

What is claimed is:

1. Apparatus to selectively deflect limbs of an archery bow, the invention comprising an elongate generally horizontal beam, first and second brackets slidably retained to the beam, the first and second brackets slidable along the beam at equal rates in opposing directions, each of the first and second brackets comprising an elongate support member extending laterally therefrom, each elongate support member engageable with an inside surface of a one of the limbs of the archery bow, a first pivot arm hinged to the first bracket, a second pivot arm hinged to the second bracket, each elongate support member having an axis substantially perpendicular to a plane defined by the pivot arms and the elongate beam, a first support bracket retained to the first pivot arm and selectively slidable therealong, a second support bracket retained to the second pivot arm and selectively slidable therealong, a limb engaging member supported on each support bracket to touchingly engage an outside surface of one of the limbs of the archery bow and to selectively urge the one of the limbs of the archery bow toward the other limb, a first elongate link hinged to the first support bracket, a second elongate link hinged to the second support bracket, an extendible length member disposed at substantially a midpoint of the horizontal beam, the extendible length member having a selectively extensible member, the first and second links hinged to the extensible member, each limb engaging member comprises a cylindrical rod, each cylindrical rod being elongate and having a longitudinal axis substantially perpendicular to the plane defined by the pivot arms and the elongate beam, each cylindrical rod having a free end, a limb support cradle selectively receivable on each of the cylindrical rods, each limb support cradle including a cylindrical opening for receiving the cylindrical rod on which the limb support cradle is receivable, each limb support cradle nonrotatable about the cylindrical rod on which it is received, each limb support cradle including a bearing surface touchingly engageable with an outer surface of one of the limbs of the bow.

2. The apparatus of claim 1 wherein each elongate link is irremovably hinged to the extensible member.

3. The apparatus of claim 1 wherein each of the links is longitudinally adjustable without disconnection of either end thereof from the apparatus.

4. The apparatus of claim 1 wherein each of the first and second elongate links comprises an outer tube and an inner tube, the inner tube telescopingly slidable within the outer tube, a one of the outer tube and the inner tube including multiple openings therealong, at least one opening along the other of the outer tube and the inner tube, the at least one opening alignable with a selected one of the multiple openings, a pin element selectively insertable through the selected one of the multiple openings and the at least one opening to selectively lock the inner tube to the outer tube, each opening of the multiple openings is associated with a distinct identifying element marked on a one of the inner tube and the outer tube.

5. The apparatus of claim 1 wherein each cylindrical rod includes plural external longitudinal splines thereon, the external splines extending around an entirety of an outer surface of each of the rods, the cylindrical opening of each limb support cradle comprising internal splines meshable with the external splines of the rods, the internal splines disposed about a circumference of the cylindrical opening of each limb support cradle.

6. The apparatus of claim 5 further characterized by each limb support cradle comprising a pair of spaced apart limb engaging elements, each limb engaging elements including a bearing surface for touchingly engaging a one of the limbs of the bow, the pair of limb engaging elements of each limb support cradle defining a gap therebetween.

7. The apparatus of claim 6 wherein each limb engaging element includes a spring biased plunger extending therefrom adjacent the bearing surface thereof, the plunger extending past the bearing surface when the plunger is fully extended, the limb engaging elements of each limb support cradle oriented such that the plungers thereof are disposed at outside edges of the limb support cradle.

8. The apparatus of claim 1 wherein a limb retaining member is selectively mounted to each of the elongate support members, each limb retaining member comprises a first pin and a second pin, the first pin being generally parallel to and selectively spaced apart from the second pin, the first pin selectively mountable to the elongate support member and the second pin selectively movable into engagement with the outer surface of a one of the limbs of the bow.

9. The apparatus of claim 1 wherein a limb retaining member is selectively mounted to each of the elongate support members, each limb retaining member comprises a hook member having a curved hook joined to a shank, and a transverse bar selectively retained to the shank, the hook selectively retained to a one of the elongate support members, the transverse bar selectively movable along the shank to touchingly engage the outer surface of a one of the limbs of the bow.

10. The apparatus of claim 1 wherein a lock element is cooperative with each support bracket to selectively prevent the support bracket from moving along the pivot arm.

11. The apparatus of claim 10 wherein each pivot arm includes a series of pin receivers therealong, each lock element comprises a pin insertable into a one of the pin receivers of the pivot arm to which the limb engagement bracket is slidably retained, each pin receiver of each pivot arm is identified with an identifier observable by a user.

12. The apparatus of claim 1 wherein each limb support cradle includes a plurality of indices disposed about the cylindrical rod receiving opening thereof, the indices fixed to each of the limb support cradles, one of the external splines of each cylindrical rod being an index spline, the index spline being marked with an identification mark affixed to the cylindrical rod, wherein each limb support cradle may be oriented on the rod on which it is received such that the index spline of the rod is aligned with a specific one of the indices of the limb support cradle.

13. The apparatus of claim 1 wherein each of the cylindrical rods including at least one first keying element thereon, the rod receiving opening of each limb support cradle including at least one second keying element, each first keying element complementary with each second keying element, the rod receiving opening of each limb support cradle receiving the cylindrical rod on which the limb support cradle is supported, the first and second keying elements preventing rotation of the limb support cradle around the cylindrical rod on which it is supported.

14. The apparatus of claim 1 wherein each link member includes a plurality of attachment points thereon, attachment point, each individual identifier marked on each of the link members, the beam comprising a plurality of indicia marked thereon, each of the indicia marking a location along the beam for location of a one of the pivot arms therealong, the other of the pivot arms moving to a point correspondingly separated from the extendible length member as the one of the pivot arms is separated from the extendible length member, each pivot arm including indicators therealong, the indicators on each pivot arm marked on the pivot arm, the indicators marking specific points along the pivot arm for location of the support bracket therealong, the extensible member of the extendible length member including indexing marks fixed therealong, wherein the bow press may be preset based upon a type or model of bow to be pressed before attachment of the bow thereto, by adjusting the links so that each link member is set to a length corresponding with a one of the individual identifiers, by adjusting the extensible member to a starting height, and by locating the support brackets along the pivot arms in accordance with a one of the indicators on each of the pivot arms.

15. The apparatus of claim 1 wherein the first and second brackets are slidable along the beam at equal rates in opposing directions as a threaded rod coupled to the first and second brackets is rotated, the threaded rod having a first end with right hand threads thereon, the right hand threads coupled to a first of the first and second brackets by a first screw follower, the threaded rod having a second end with left hands threads thereon, the left hand threads coupled to a second of the first and second brackets by a second screw follower, the threaded rod supported by a central bracket depending from the beam, the threaded rod extending substantially the entire length of the beam, a gear box coupled to an end of the threaded rod, the gear box housing a spider gear, a crank member selectively operatively coupled to the gear box, the crank member rotatable about a drive axis, the drive axis substantially perpendicular to a longitudinal axis of the threaded rod, the spider gear coupling the crank member to the threaded rod.

16. In a bow press having an elongate beam, a pair of pivot arms retained to the beam and selectively moveable therealong, the pivot arms pivotable upon the beam, each pivot arm having an elongate link member hinged thereto, the elongate link members each being selectively joined along distal ends thereof to an extensible section of a telescoping member, the improvement comprising each link member including a plurality of attachment points thereon, each attachment point identified by an individual identifier specific to the attachment point, each individual identifier marked on the link member adjacent each attachment point of the plurality of attachment points, the beam comprising indicia thereon, the indicia marking locations along the beam for location of at least one of the pivot arms therealong, the indicia fixed along at least a first half of the beam, each pivot arm including indicators therealong, the indicators marking specific points along the pivot arm for location of a limb support bracket therealong, each indicator marked on each pivot arm adjacent a specific one of the specific points along the pivot arm, each link member hinged to one of the limb support brackets, the extensible section of the telescoping member including indexing marks affixed therealong, whereby the bow press may be preset based upon a type or model of bow to be pressed, each pivot arm supports a limb engaging member thereon, each limb engaging member selectively supporting a limb cradle thereon, each limb cradle comprising a pair of limb cradle members, each limb cradle member including a cylindrical opening, the cylindrical opening including internal splines thereabout, each limb engaging member comprising a cylindrical rod, the cylindrical rod having external splines thereon, the external splines surrounding a longitudinal segment of the cylindrical rod, orientation markings disposed on the limb cradle, the orientation markings disposed adjacent the cylindrical opening of each limb cradle member, at least one index mark on the limb engaging member, the at least one index mark fixed to the cylindrical rod and aligned with a one of the splines thereof, wherein each limb cradle may be oriented on the limb engaging member at a predetermined orientation by alignment of the at least one index mark with a selected one of the orientation markings on the limb cradle.

* * * * *